United States Patent [19]

Yamashita et al.

[11] 4,446,226

[45] May 1, 1984

[54] LIGHT-SENSITIVE COLOR PHOTOGRAPHIC MATERIAL

[75] Inventors: Kiyoshi Yamashita; Toshifumi Iijima, both of Hino, Japan

[73] Assignee: Konishiroku Photo Industry Co., Ltd., Tokyo, Japan

[21] Appl. No.: 397,083

[22] Filed: Jul. 12, 1982

[30] Foreign Application Priority Data

| | | | |
|---|---|---|---|
| Jul. 10, 1981 | [JP] | Japan | 56-106908 |
| Dec. 11, 1981 | [JP] | Japan | 56-200477 |
| Dec. 12, 1981 | [JP] | Japan | 56-200611 |
| Dec. 13, 1981 | [JP] | Japan | 56-200552 |

[51] Int. Cl.[3] ..... G03C 1/46; G03C 7/26

[52] U.S. Cl. ..... 430/506; 430/502; 430/503; 430/509; 430/567

[58] Field of Search ..... 430/502, 503, 505, 506, 430/509, 567, 569

[56] References Cited

U.S. PATENT DOCUMENTS

| | | | |
|---|---|---|---|
| 4,153,460 | 5/1979 | Iijima et al. | 430/505 |
| 4,187,110 | 2/1980 | Yagihara et al. | 430/957 |

*Primary Examiner*—Mary F. Downey

*Attorney, Agent, or Firm*—Frishauf, Holtz, Goodman & Woodward

[57] ABSTRACT

A light-sensitive color photographic material having a support and, coated thereon, at least two light-sensitive silver halide emulsion layers respectively sensitive to lights of different spectral regions, characterized in that each of the light-sensitive emulsion layers comprises at least two emulsion layers having different light-sensitivities and containing negative type light-sensitive silver halide crystals essentially consisting of silver iodobromide containing silver iodide at a proportion not higher than 4 mole %.

This invention provides a silver halide color photographic material, in which the proportion of the silver halide utilized for the information of a color image to the total silver halide used is enhanced remarkably.

9 Claims, No Drawings

LIGHT-SENSITIVE COLOR PHOTOGRAPHIC MATERIAL

This invention relates to a light-sensitive color photographic material, and particularly to a light-sensitive color photographic material for use of photographing an object in a camera. More particularly, this invention relates to a multi-layer silver halide light-sensitive color photographic material for high-sensitivity photographing, in which the efficiency of utilizing the silver halide in a negative type silver halide emulsion for the formation of a dye image is improved.

Generally, light-sensitive color photographic materials used for the photographing purposes are required to exhibit a high sensitivity and a high image quality. Sensitivity of a silver halide depends on the size of silver halide crystals, and it is necessary to use relatively coarse silver halide crystals in order to obtain a high sensitivity. However, graininess of a dye image is decisively affected by the size of silver halide crystals. Therefore, it has been proposed to use a multi-layer light-sensitive color photographic material comprising two or more layers exhibiting sensitivity of light in the same spectral region and forming a dye of the same hue. Light-sensitive color photographic materials of this type are described for example in West German Patent No. 1121470, British Pat. No. 923,045, Japanese Patent Publication No. 15495/1974, Japanese Provisional Patent Publication Nos. 49027/1976, 143016/1977, 97831/1978 and 97424/1978. It is also known to form a light-sensitive photographic material comprising only one layer by using a mixture of a high-sensitivity emulsion containing relatively coarse crystals sensitive to light in a particular visible spectral region and a low-sensitivity emulsion containing relatively fine crystals. However, the material of this type is not popular because of its inferior graininess.

The present invention relates to a multi-layer light-sensitive color photographic material comprising at least two layers exhibiting different spectral sensitivities, and each layer exhibiting the same spectral sensitivity i.e. each layer exhibiting sensitivity to light in the same visible spectral region and forming a dye of the same hue is further constituted by two or more layers.

In silver halide light-sensitive color photographic materials, silver is used as the raw material for light-sensitive substance. In spite of small amount of silver deposits, silver is widely used for industrial, trinketry and medical purposes and the like. Thus, need exists for reduction in the amount of silver used in silver halide light-sensitive photographic materials for the purpose of preserving resources and also reducing the cost of silver halide light-sensitive photographic materials because of recent remarkable rise in the price of silver.

Usually, in silver halide light-sensitive color photographic materials for high-sensitivity photographing, negative type silver iodobromide containing silver iodide at a high molar percentage is used as the light-sensitive silver halide. However, with a light-sensitive material in which negative silver iodobromide containing silver iodide at a high molar percentage is used as the light-sensitive silver halide, the number of silver halide crystals not utilized for the image formation (hereinafter referred to as the dead grains) increases at the portion of maximum density in an image obtained upon exposure through an optical wedge. Thus, only about 40% of the exposed silver iodobromide crystals is utilized for the image formation. Although the mechanism of this phenomenon has not been completely clarified, it is assumed attributable to the occurrence of latent image bleaching during the development processing. In the color development, the proportion of the developed silver utilized for the formation of a color image is at most about 60% at the portion of maximum density because an oxidized product of the color developing agent is subjected not only to the reaction with a coupler but also to various reactions as described for example by T. H. James in "The Theory of the Photographic Process", Chapter 12, Section II, Macmillan Co., 1977. Therefore, because of the above-mentioned two factors affecting the utilization efficiency, the proportion of the silver halide actually utilized for the formation of a color image is 25% or less of the silver amount used.

On the other hand, in a multi-layer light-sensitive color photographic material comprising at least two layers exhibiting different spectral sensitivities, and each layer exhibiting the same spectral sensitivity is further constituted by two or more layers, it is known to adjust the maximum color density of the high sensitivity layer by lowering the concentration of a coupler in the high sensitivity emulsion layer so as to improve graininess of the high sensitivity layer using relatively coarse silver halide crystals. However, if the concentration of the coupler is lowered, there is a serious drawback in that, many dead grains occur, resulting in low efficiency of silver halide utilization and low apparent sensitivity of the silver halide crystals.

Silver halide light-sensitive color photographic materials are generally subjected to color development after the imagewise exposure. Recently, the temperature of the color development is gradually raised for the purpose of meeting the need for quick processing. In many cases, the color development is conducted at a temperature between 35° and 40° C. for 3 to 3.5 minutes. However, to maintain such high processing temperatures, it is necessary to use much energy and to keep the concentration of the processing solution at a constant level as the solvent evaporates. Further, the processing solution deteriorates quickly as the processing temperature rises. Thus, need exists for a silver halide light-sensitive color photographic material capable of being developed at as low temperatures as possible.

The primary object of the present invention is to provide a silver halide light-sensitive color photographic material for high-sensitivity photographing which eliminates the disadvantages of the conventional techniques described above, and particularly a silver halide light-sensitive color photographic material for high-sensitivity photographing in which the proportion of the silver halide amount utilized for the formation of a color image to the amount of silver halide used is enhanced remarkably.

Another object of the present invention is to provide a silver halide light-sensitive color photographic material for high-sensitivity photographing, in which a negative type silver iodobromide emulsion having few dead grains is used.

A further object of the present invention is to provide a silver halide light-sensitive color photographic material for high-sensitivity photographing, in which the degree of color formation is increased with respect to the unit amount of developed silver.

A still further object of the present invention is to provide a silver halide light-sensitive color photographic material for high-sensitivity photographing, which is suitable for a low-temperature quick color development system.

The present invention provides a light-sensitive color photographic material having a support and, coated thereon, at least two light-sensitive silver halide emulsion layers respectively sensitive to lights of different spectral regions, each of which emulsion layers comprises at least two emulsion layers having different light-sensitivities and containing negative type light-sensitive silver halide crystals essentially consisting of silver iodobromide containing silver iodide at a proportion not higher than 4 mol %. The light-sensitive color photographic material characterized as described above is hereinafter referred to as the light-sensitive color photographic material in accordance with the present invention.

The above objects can be accomplished by the light-sensitive color photographic material described below in detail.

Namely, in the light-sensitive color photographic material in accordance with the present invention, a negative type silver halide emulsion having the sensitivity speck mainly at the surfaces of the silver halide crystals is used as the silver halide emulsion. The emulsion is of the surface latent image type, which means reversely from the so-called internal latent image type direct positive emulsion, namely means an emulsion which yields a blackened silver image in inverse proportion to the lightness of the object when developed with a surface developing solution after the exposure.

In the silver iodobromide emulsion, it is well known that more rapid development characteristics can be obtained as the molar percentage of silver iodide decreases. The inventors further studied this phenomenon and found that, although dead grains decrease as the molar percentage of silver iodide decreases in the case of a single layer, this feature does not occur remarkably if such a layer is stacked on or sandwiched between silver iodobromide emulsion layers containing a large molar percentage of silver iodide. Further studies revealed that, even in stacked layers, dead grains can be reduced if all of the negative type silver halide light-sensitive emulsions in the multi-layer silver halide light-sensitive material comprise silver iodobromide of low molar percentage of silver iodide. It was also revealed that the amount of dye formed per unit amount of developed silver increases considerably. The inventors presumes that dead grains occur because a small size latent image is bleached by an oxidized product of the developing agent. It is assumed that dead grains decrease in the case of low-iodine silver iodobromide because, if the development speed is high, the latent image quickly grows to a stable development nucleus, and that a relatively large amount of iodine occurring in a layer containing a large molar percentage of silver iodide restricts the development when a layer containing a small molar percentage of silver iodide is stacked on a silver iodobromide layer containing a large molar percentage of silver iodide.

It is not clear why the amount of a dye formed per unit amount of developed silver increases.

The silver halide used in the light-sensitive color photographic material in accordance with the present invention substantially consists of a negative type silver iodobromide containing 4 mole % or less of silver iodide. This means that the average content of silver iodide in the silver iodobromide crystals should be 4 mole % or less, and there may partially exist silver iodobromide crystals which contain more than 4 mole % of silver iodide and which are generated during the production process of silver halide. In the present invention, silver iodobromide preferably means the silver iodobromide containing 0.1 mole % or more of silver iodide. The preferable molar percentage of silver iodide in the present invention is between 1 and 3 mole %. The silver iodobromide may contain silver chloride, silver bromide, silver chlorobromide and/or a mixture thereof insofar as the effect of the present invention is not adversely affected. The silver iodobromide emulsion may contain large or small crystals, and may be monodispersed or polydispersed. However, the effect of the present invention is particularly remarkable when the emulsion is monodisperse. It is particularly preferable that the coefficient of variation obtained by dividing the standard deviation S (defined below) by the average crystal size r is 0.15 or less.

$$S = \frac{\sqrt{\Sigma(\bar{r} - r_i)^2 n_i^2}}{\Sigma n_i}$$

$$\frac{S}{\bar{r}} \leqq 0.15$$

The average crystal size as used herein means the average value of the diameters of silver halide crystals when they are spherical. When the crystals are cubic or not spherical, their projected images are converted to circular images of the same area, and the average of the diameters of the circular images is taken as the average crystal size. The average crystal size is defined by:

$$\bar{r} = \frac{\Sigma n_i r_i}{\Sigma n_i}$$

where $r_i$ designates the crystal sizes of individual grains, and $n_i$ designates the number of the crystals.

In the silver halide light-sensitive color photographic material according to the present invention, each emulsion layer containing negative type silver halide crystals having the same spectral sensitivity is constituted by at least two negative type silver halide emulsion layers having different light sensitivities.

It is preferable that the upper layer, viewed from the support, has a light sensitivity higher than that of the lower layer. Further, in the present invention, it is preferable that the at least two layers each having the same spectral sensitivity have the average crystal sizes of the silver halide crystals different from each other. For example, it is preferable that the average grain size of the silver halide grains contained in the emulsion layer having a higher light sensitivity is in the range between 0.5μ and 1.5μ, while that in the emulsion layer having a lower light sensitivity is in the range between 0.3μ and 0.8μ.

The light-sensitive color photographic material in accordance with the present invention comprises at least two kinds of emulsion layers which contain negative type silver halide crystals exhibiting different spectral sensitivities and which respectively consist of a plurality of layers. In the case of a light-sensitive natural color photographic material, three emulsion layers exhibiting different spectral sensitivities are generally used, and these layers are positioned in the order of for example red-sensitive, green-sensitive, and blue-sensitive emulsion layers from the side of the support towards the outermost layer. In this case, the proportion of silver iodide to the silver iodobromide in each layer should be 4 mole % or less. It is more preferable that the difference between the contents of silver iodide in the silver iodobromide emulsion layer containing the maximum molar percentage of silver iodide and that containing the minimum molar percentage of silver iodide is 2 mole % or less whereby the occurrence of dead grains is reduced much more. The molar percentage of silver iodide in the silver iodobromide contained in each layer is not limited in sofar as the silver halide light-sensitive emulsion contained in each of the two or more layers each exhibiting the same spectral sensitivity substantially consists of silver iodobromide containing 4 mole % or less of silver iodide. However, because of little occurrence of dead grains, it is preferable that the difference between the molar percentage of silver iodide in the silver iodobromide in the respective layers is small. Further, it is preferable that the difference between the molar percentage of silver iodide in the layer containing the maximum molar percentage of silver iodide and the layer containing the minimum molar percentage of silver iodide is 2 mole % or less.

The silver halide crystals used in the light-sensitive color photographic material in accordance with the present invention may be the so-called twinned crystals having irregular shapes such as sherical or plate-like shape, or may be of a regular shape such as cube, octahedron and tetradecahedron. Preferably, they are octahedral or tetradecahedral since lesser dead grains are generated. It is also possible to be a mixture of grains having a regular shape and an irregular shape.

The silver halide crystals used in the light-sensitive color photographic material in accordance with the present invention may be prepared by the acid process, neutral process or ammonia process. It is also possible to prepare seed crystals by the acid process, and grow them up to the predetermined size by the ammonia process which gives a high growth rate. When growing the silver halide crystals, it is desirable that the pH, pAg or the like in the reactor are controlled, and silver ions and halide ions are both poured sequentially and simultaneously and mixed in quantities matching the growth rate of silver halide grains, that is so called double jet method as described for example in Japanese Provisional Patent Publication No. 48521/1979.

The silver halides may be chemically sensitized with active gelatin; a sulfur sensitizer e.g. allylthiocarbamide, thiourea or cystine; a selenium sensitizer; a reduction sensitizer e.g. tin (II) salt, thiourea dioxide and polyamine; a noble metal sensitizer, e.g. gold sensitizer such as potassium aurithiocyanate, potassium chloroaurate, water-soluble gold salts or a water-soluble salt of ruthenium, platinum, rhodium or iridium, e.g. potassium chloroplatinate (some of these serve as sensitizers or fog restrainers depending on the amount used). These sensitizers may be used alone or in combination (e.g. a combination of the gold sensitizer with the sulfur sensitizer, or a combination of the gold sensitizer with selenium sensitizer).

Further, the silver halides may be optically sensitized (in which so-called super-sensitization may be obtained) to a desired wavelength region for example by using an optical sensitizer e.g. a cyanine dye such as zeromethine dye, monomethine dye, dimethine dye or trimethine dye, or a merocyanine dye singly or in combination of two or more.

As for the coupler used in the light-sensitive color photographic material in accordance with the present invention, i.e. the compound forming a dye by the reaction with an oxidized product of the color developing agent, it is sufficient only if it exists substantially at the time of color development. The coupler may be contained in the color developing solution or in the light-sensitive color photographic material. When the coupler is non-diffusion type, it is preferably contained in the light-sensitive color photographic material.

Generally, the coupler is contained in the light-sensitive layer of the light-sensitive color photographic material.

The coupler can be incorporated in the light-sensitive color photographic material in various ways in accordance with the present invention. When the coupler is soluble in an alkali, it may be added in the form of an alkaline solution. When it is soluble in an oil, it is preferably dissolved in a high boiling solvent optionally in combination with a low boiling solvent and finely dispersed in the silver halide emulsion according to the procedures described in U.S. Pat. Nos. 2,322,027, 2,801,170, 2,801,171, 2,272,191 and 2,304,940. In this case, it is also possible to additionally add a hydroquinone derivative, an ultra violet ray absorber, a discoloration preventing agent or the like as required. It is also possible to use a mixture of two or more couplers. In the incorporation of the coupler into the light-sensitive material, one or more couplers may be dissolved optionally together with another coupler,. a hydroquinone derivative, a discoloration preventing agent, an ultra violet ray absorber or the like as required in a high boiling solvent such as an organic acid amide, a carbamate, an ester, a ketone, a urea derivative or the like, particularly di-n-butyl phthalate, tri-cresyl phosphate, triphenyl phosphate, di-isooctyl azelate, di-n-butyl sebacate, tri-n-hexyl phosphate, N,N-diethyl-caprylamide butyl, N,N-diethyllaurylamide, n-pentadecyl phenyl ether, dioctyl phthalate, n-nonyl phenol, 3-pentadecylphenyl ethyl ether, 2,5-di-sec.-amylphenyl butyl ether, monophenyl-di-o-chlorophenyl phosphate, or a fluoroparaffin, or if necessary in a low boiling solvent such as methyl acetate, ethyl acetate, propyl acetate, butyl acetate, butyl propionate, cyclohexanol, diethylene glycol monoacetate, nitromethane, carbon tetrachloride, chloroform, cyclohexane, tetrahydrofuran, methyl alcohol, acetonitrile, dimethylformamide, dioxane or ethyl methyl ketone. The solution thus formed may be mixed with an aqueous solution containing a hydrophilic binder such as gelatin and an anionic surface active agent such as alkylbenzenesulfonate or alkylnaphthalenesulfonate and/or a nonionic surface active agent such as sorbitan sesquioleate or sorbitan monolaurate. The mixture thus obtained may then be emulsified and dispersed in a high-speed rotating mixer, colloid mill, supersonic dispersing unit or the like, and added to a constituent of the light-sensitive color photographic material in accordance with the present invention, preferably the silver halide emulsion.

Further, the coupler may be dispersed in the photosensitive material by a latex dispersing method.

The latex dispersing method and its effect are described for example in Japanese Provisional Patent Publication Nos. 74538/1974, 59943/1976 and 32552/1979, and "Research Disclosure", August 1976, No. 14850, pages 77–79.

Examples of suitable lateces are homopolymers, copolymers and terpolymers of monomers such as styrene, ethyl acrylate, n-butyl acrylate, n-buty methacrylate, 2-acetoacetoxyethyl methacrylate, 2-(methacryloyloxy) ethyltrimethylammonium sulfate, sodium 3-(methacryloyloxy) propane-1-sulfonate, N-isopropylacrylamide, N-[2-(2-methyl-4-oxopentyl)]acrylamide, and 2-acrylamido-2-methylpropane sulfonate.

The amount of the coupler used is not critical. However, when it is added to the light-sensitive color photographic material, it is preferably used in an amount between 10 g and 100 g per one mole of silver halide. When it is added to the color developing solution, it is used preferably in an amount between about 0.1 g and 3 g per liter of the color developing solution.

For the purpose of preventing the dye from discolorating due to active rays having a short wavelength, it is advantageous to use ultraviolet ray absorbers such as thiazolidone, benzotriazole, acrylonitrile and benzophenone compounds together with the coupler in the light-sensitive color photographic material in accordance with the present invention. It is particularly advantageous to use *Tinuvin* P's, 320, 326, 327 and 328 (available from Ciba-Geigy AG) alone or in combination.

The hydroquinone derivatives used together with the coupler in the light-sensitive color photographic material in accordance with the present invention also include their precursors. The precursors as used herein mean the compounds releasing hydroquinone derivatives by hydrolysis.

Examples of the discoloration preventing agents used together with the coupler in the present invention preferably include coumarone, coumaran and spirochroman compounds and the like.

The coupler used in the light-sensitive color photographic material in accordance with the present invention may be of either two or four equivalent type of an optional combination thereof.

Further, the coupler may be a low molecular coupler or the so-called polymeric coupler.

The coupler used in the light-sensitive color photographic material in accordance with the present invention may be any of the known photographic couplers, preferably α-acylacetamide yellow coupler (α-benzoylacetanilide yellow coupler, α-pivaloylacetanilide yellow coupler or the like), 5-pyrazolone magneta coupler, pyrazolinobenzoimidazole magenta coupler, phenol cyan coupler or naphthol cyan coupler.

Typical examples of the α-acylacetamide yellow couplers used in the present invention are:

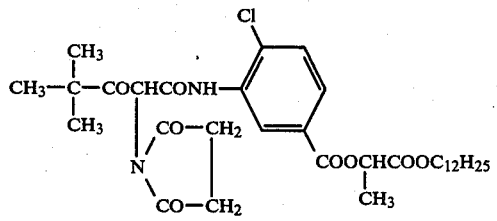

[Y-1]

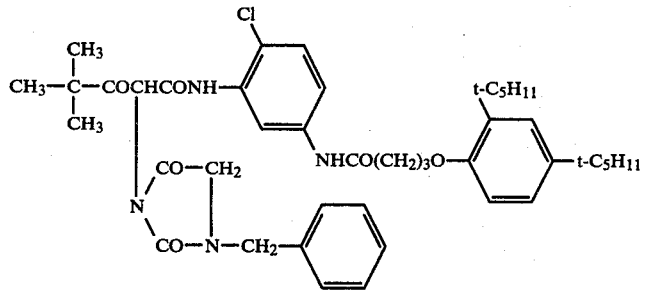

[Y-2]

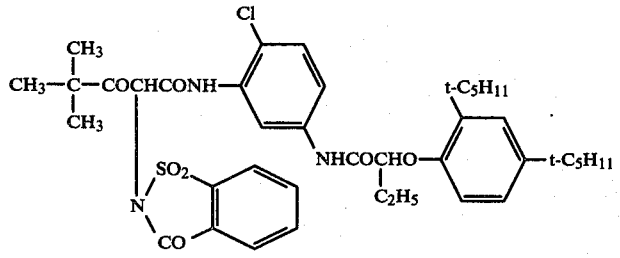

[Y-3]

-continued
[Y-4]
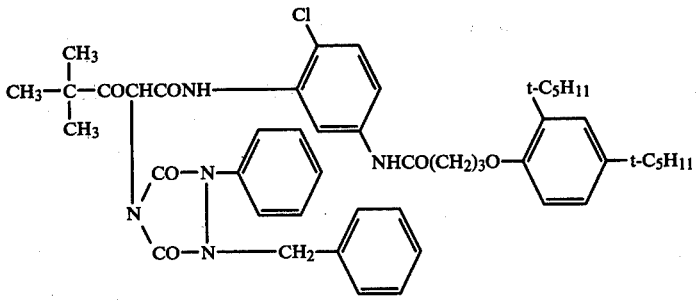
[Y-5]
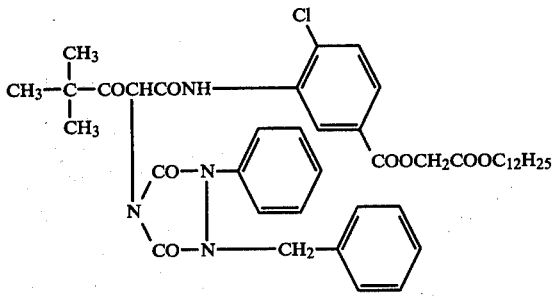
[Y-6]
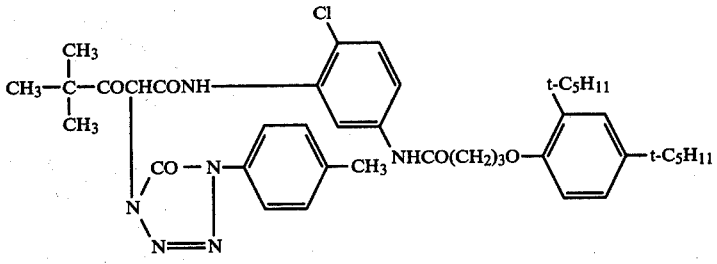
[Y-7]
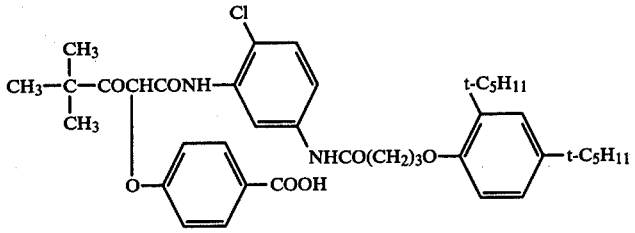
[Y-8]
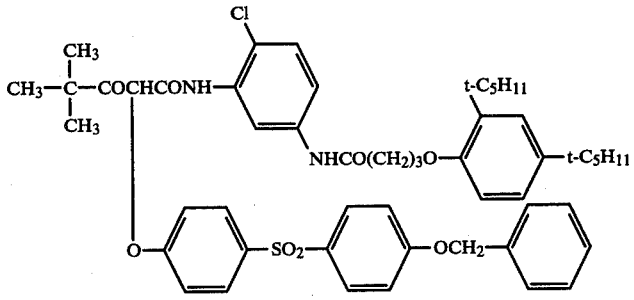
[Y-9]
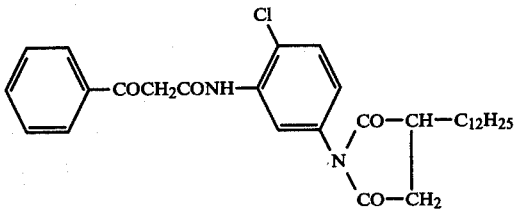

-continued
[Y-10]
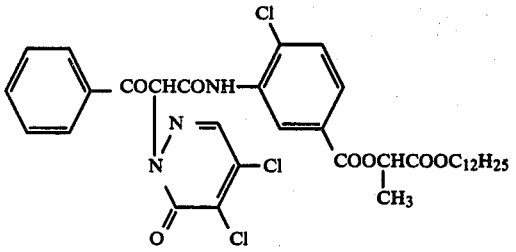
[Y-11]
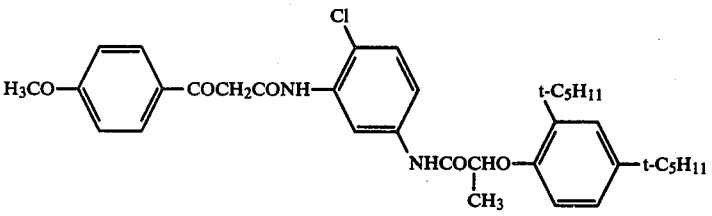
[Y-12]
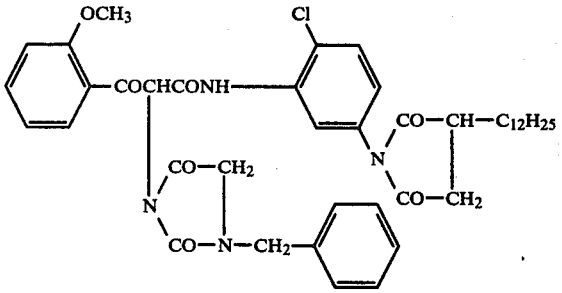
[Y-13]
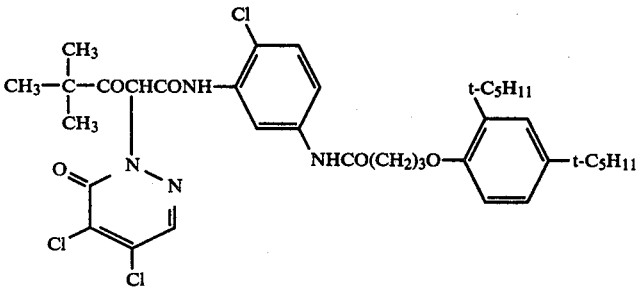
[Y-14]
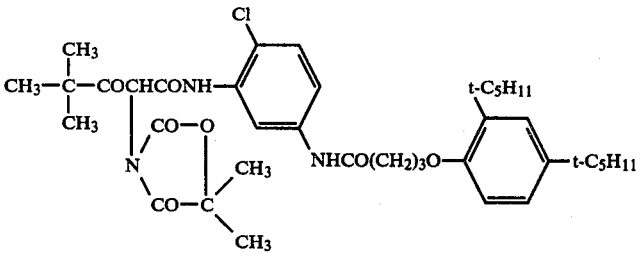

-continued
[Y-15]
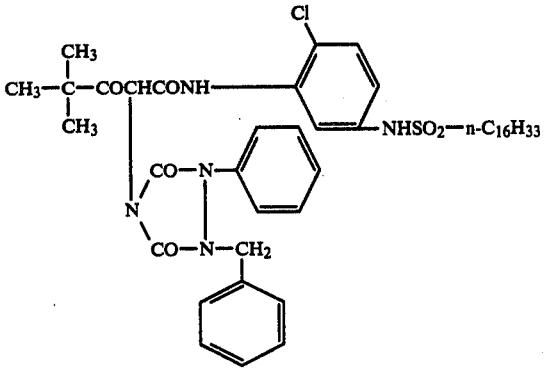
[Y-16]
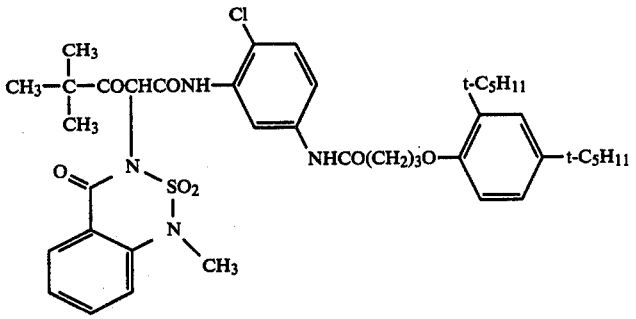
[Y-17]
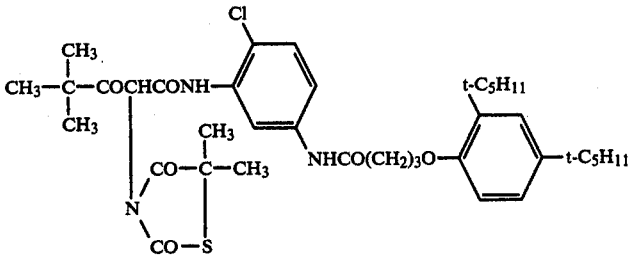
[Y-18]
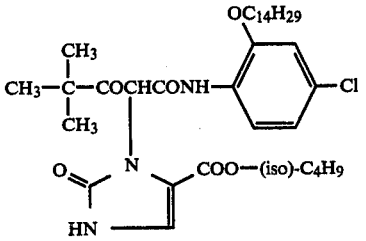
[Y-19]
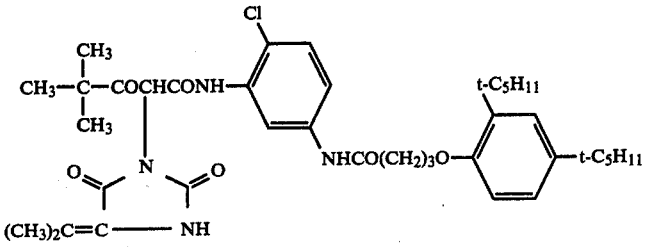

-continued

[Y-20]

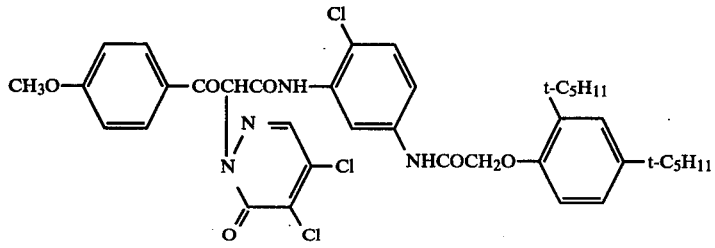

[Y-21]

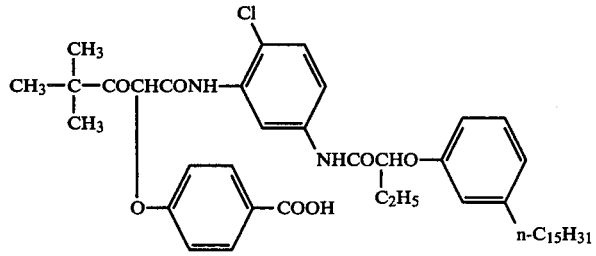

[Y-22]

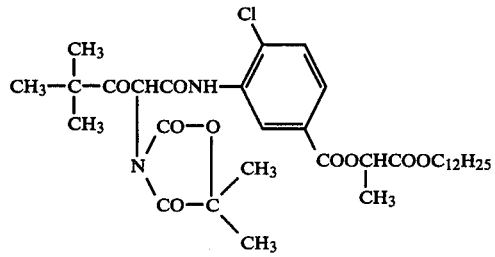

[Y-23]

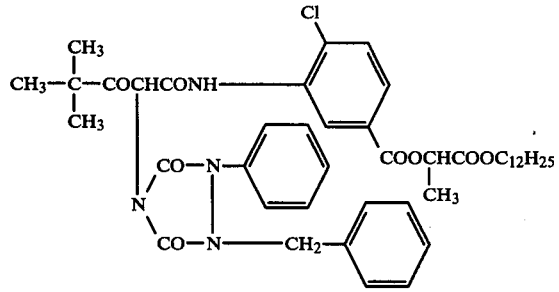

The above-described α-acylacetamide yellow couplers used in the present invention can be prepared by the methods described for example in West German Offenlegungsschrift Nos. 2,057,941 and 2,163,812, Japanese Provisional Patent Publication Nos. 26133/1972 and 29432/1973, U.S. Pat. Nos. 3,227,550, 2,875,057 and 3,265,506, Japanese Provisional Patent Publication Nos. 66834/1973, 66835/1973, 94432/1973, 1229/1973, 10736/1974, 34232/1975, 65231/1975, 117423/1975, 3631/1976 and 50734/1976.

The α-acylacetamide yellow couplers may be contained in the silver halide emulsion layer individually or as a mixture of two or more couplers. They may be incorporated by the above-mentioned procedures in an amount 1–30 mole % of blue-sensitive silver halide.

Typical examples of the cyan couplers used in the present invention are:

[C-1]

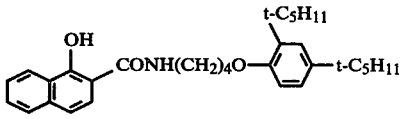

-continued

[C-2]

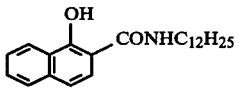

[C-3]

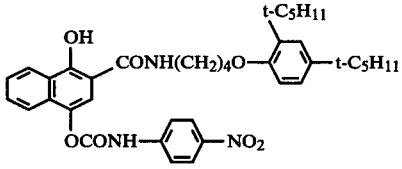

[C-4]

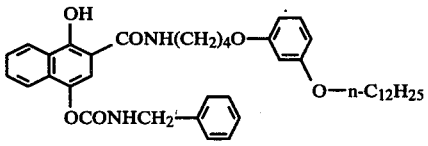

-continued
[C-5]
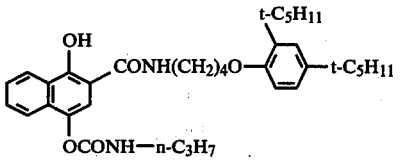
[C-6]
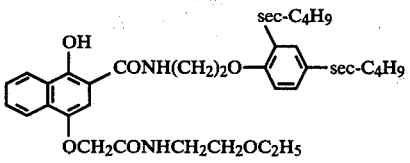
[C-7]
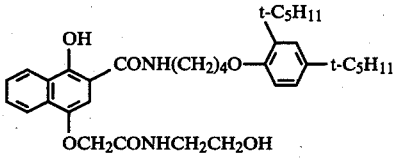
[C-8]
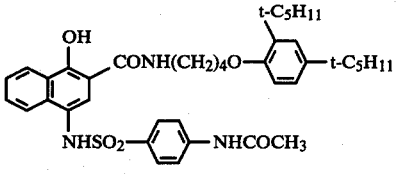
[C-9]
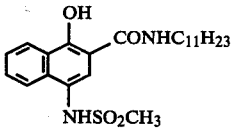
[C-10]
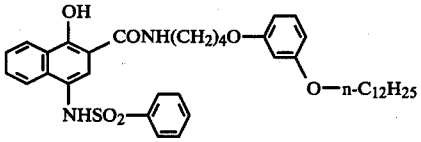
[C-11]
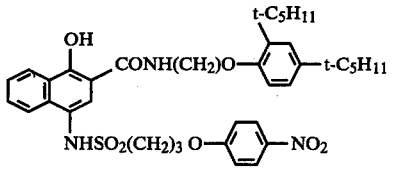
[C-12]
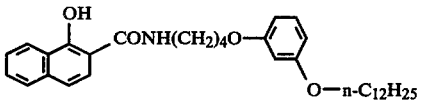
[C-13]
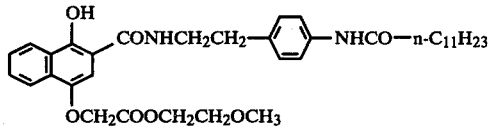
[C-14]
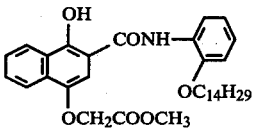
-continued
[C-15]
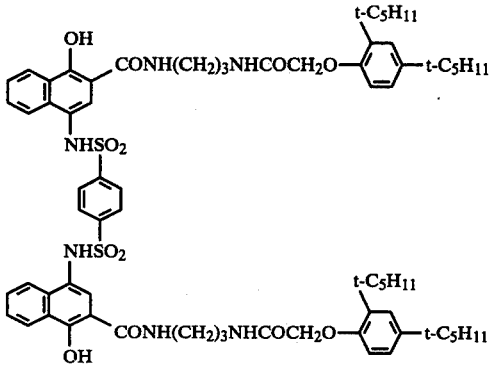
[C-16]
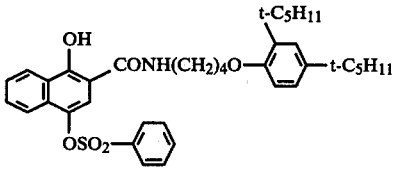
[C-17]
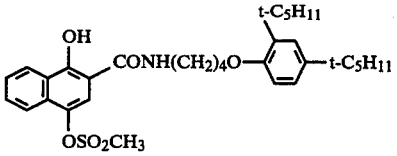
[C-18]
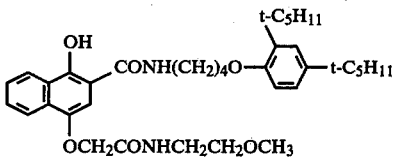
[C-19]
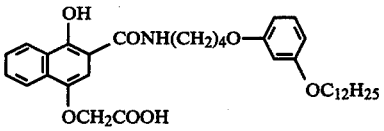
[C-20]
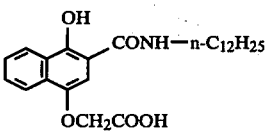
[C-21]
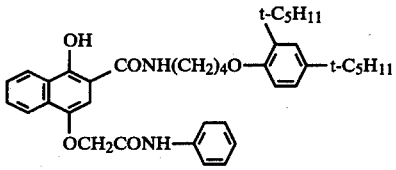
[C-22]
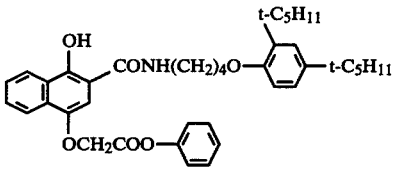
[C-23]
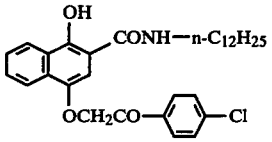

-continued

[C-24]

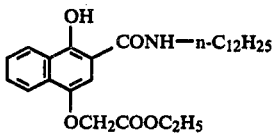

[C-25]

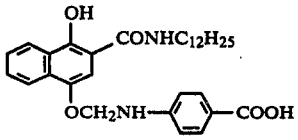

[C-26]

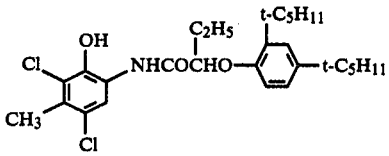

[C-27]

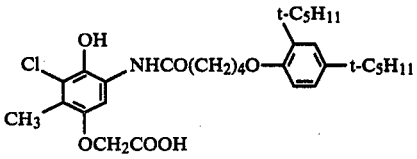

[C-28]

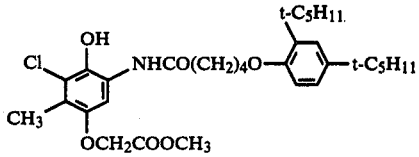

[C-29]

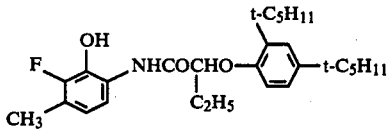

[C-30]

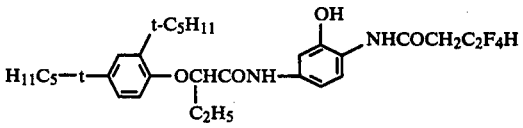

-continued

[C-31]

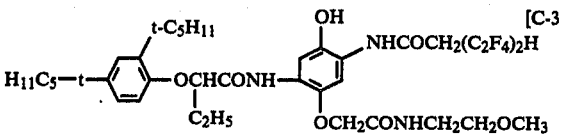

[C-32]

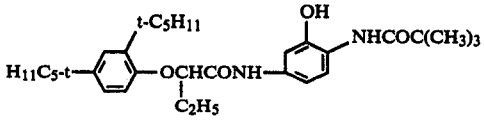

[C-33]

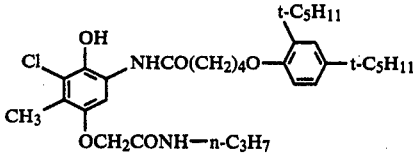

[C-34]

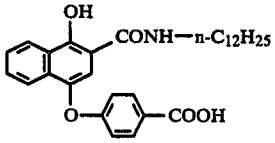

[C-35]

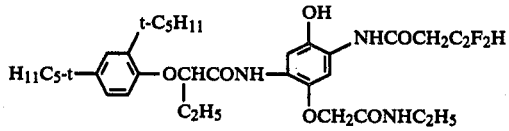

The cyan couplers used in the present invention can be prepared by the methods described for example in British Pat. No. 1,084,480, Japanese Provisional Patent Publication Nos. 117422/1975, 10135/1975, 37647/1976, 25228/1975 and 130441/1975. They are contained alone or in combination in the silver halide emulsion layer or contained in admixture with a so-called active-point arylazo-substituted colored coupler as described in U.S. Pat. No. 3,034,892, etc. They are incorporated by conventional procedure in an amount between 1 and 30 mole % of silver halide.

Examples of the preferable magenta couplers used in the present invention are:

[M - 1]

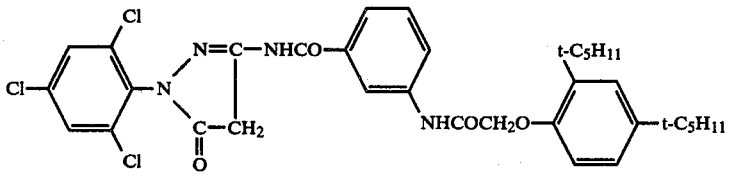

[M - 2]

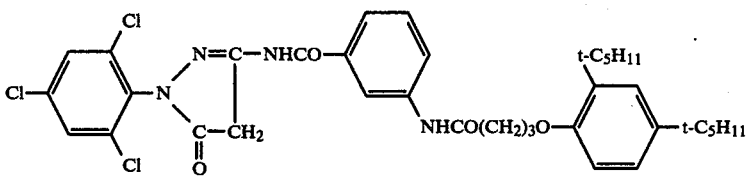

-continued
[M - 3]
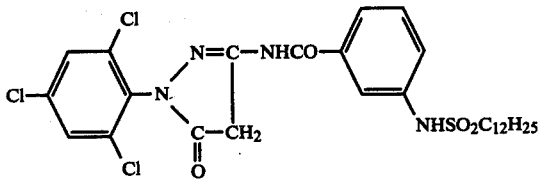
[M - 4]
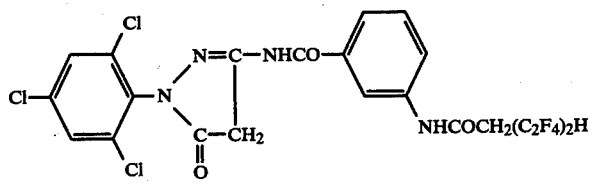
[M - 5]
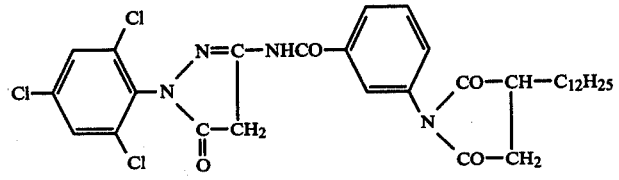
[M - 6]
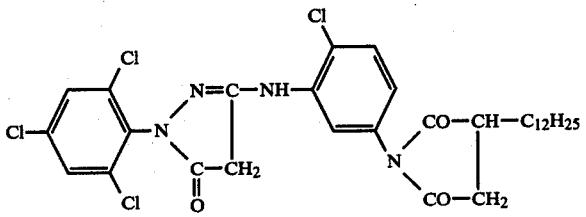
[M - 7]
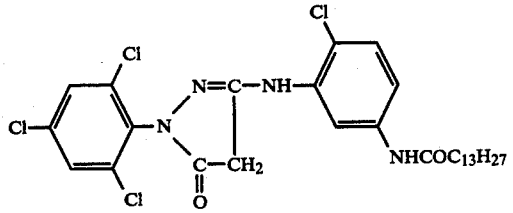
[M - 8]
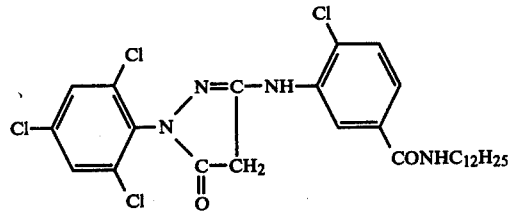
[M - 9]
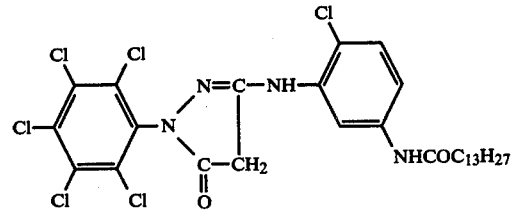
[M - 10]
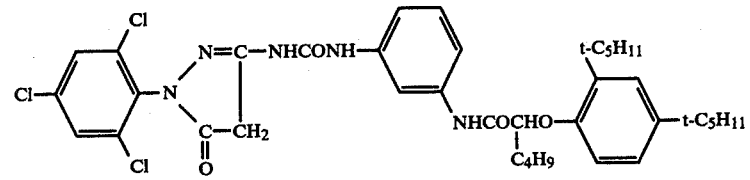

-continued
[M - 11]
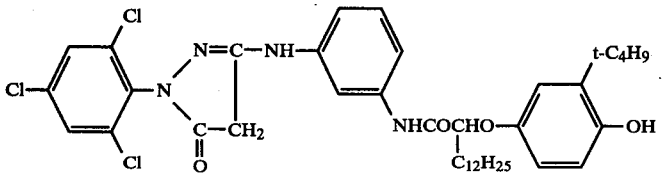
[M - 12]
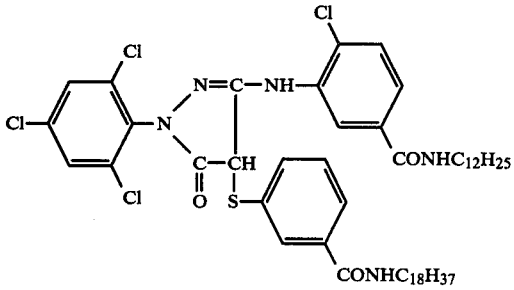
[M - 13]
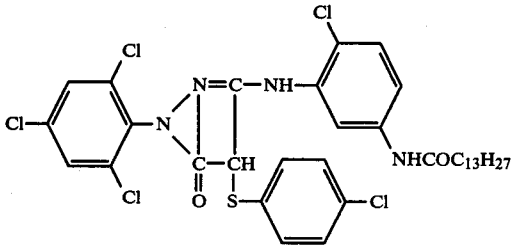
[M - 14]
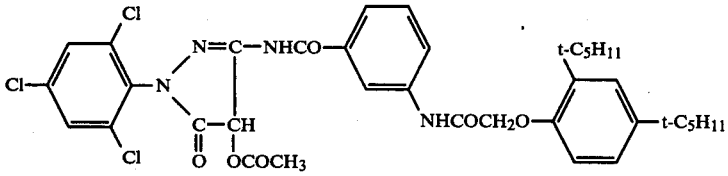
[M - 15]
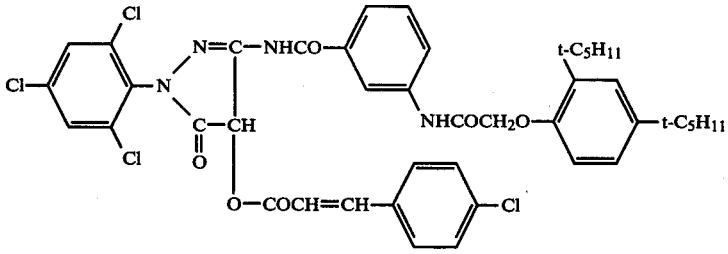
[M - 16]
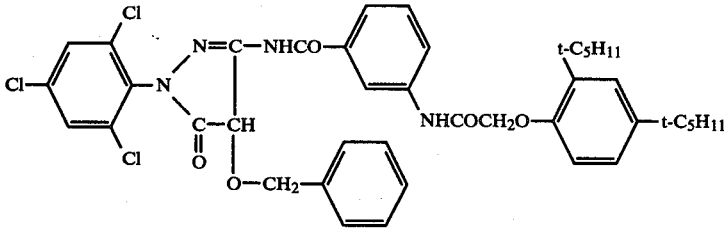

-continued
[M - 17]
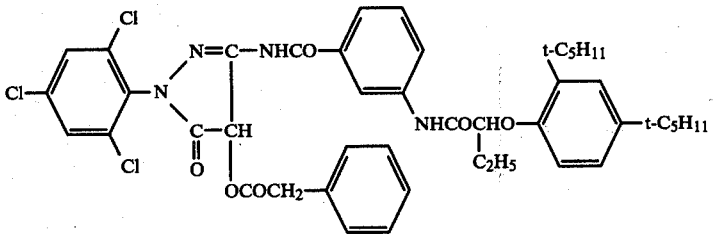
[M - 18]
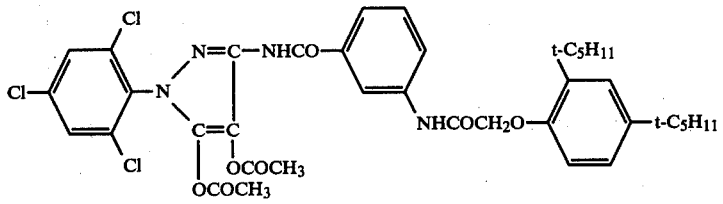
[M - 19]
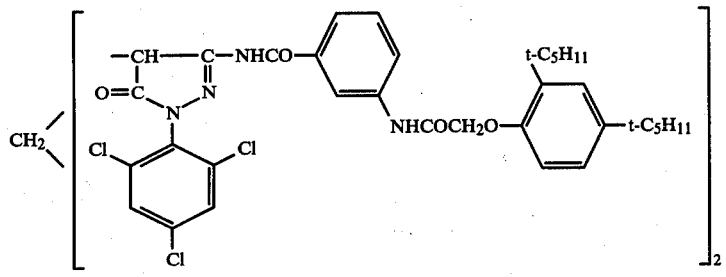
[M - 20]
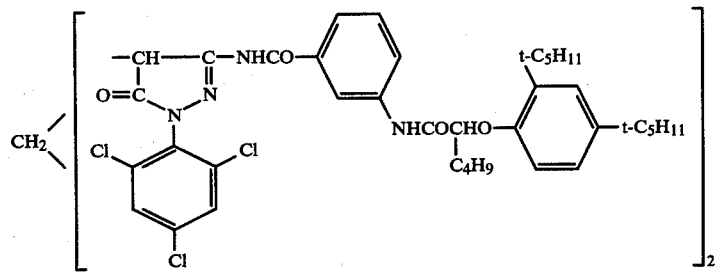
[M - 21]
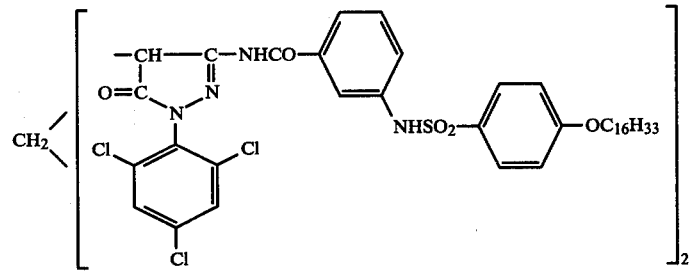
[M - 22]
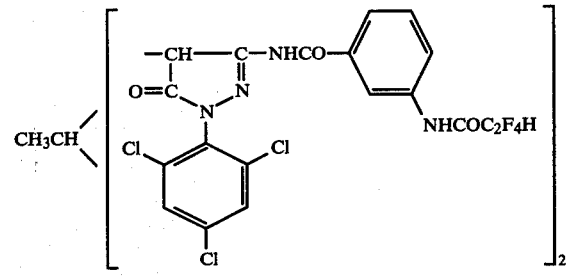

-continued
[M - 23]
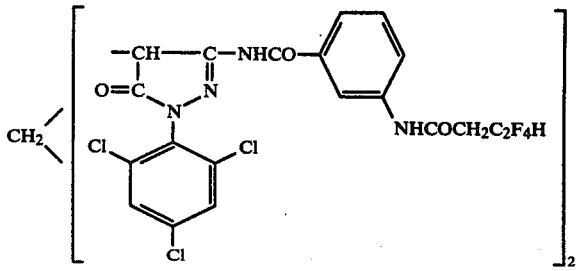
[M - 24]
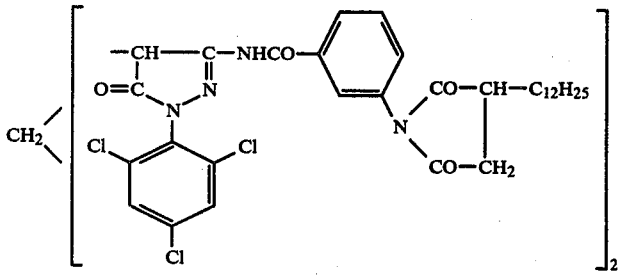
[M - 25]
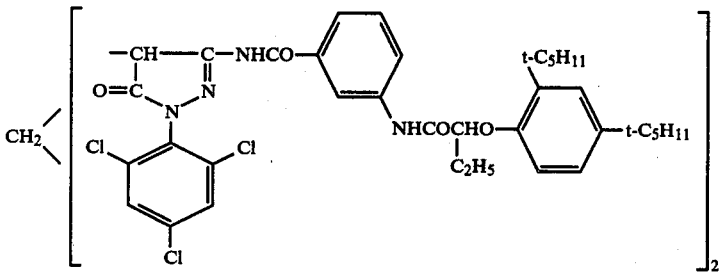
[M - 26]
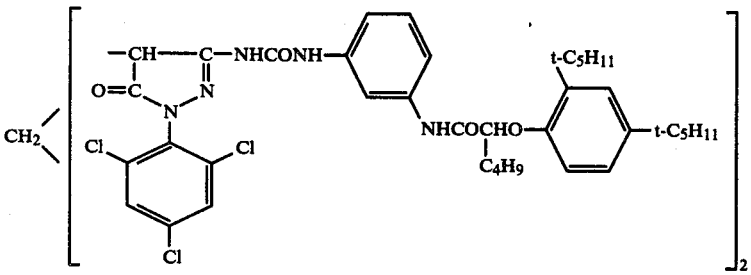
[M - 27]
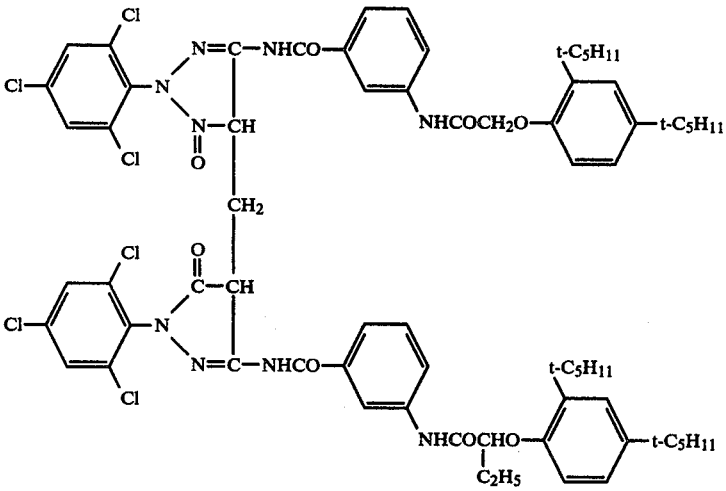

-continued
[M - 28]
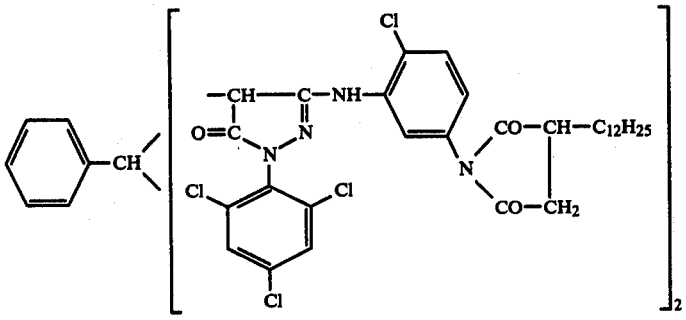
[M - 29]
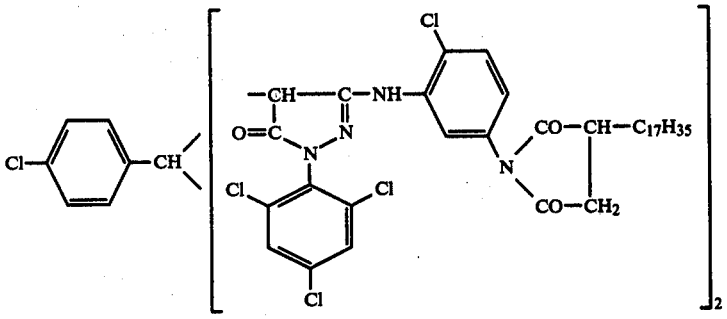
[M - 30]
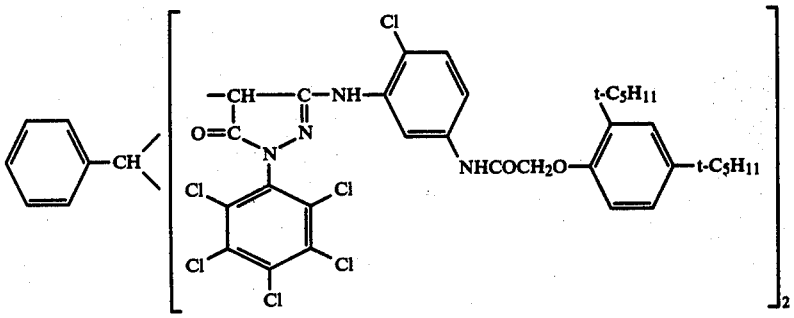
[M - 31]
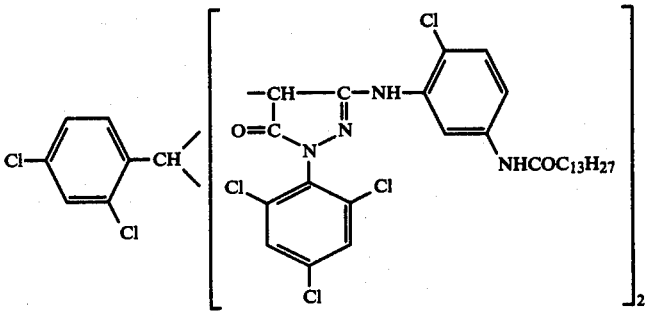
[M - 32]
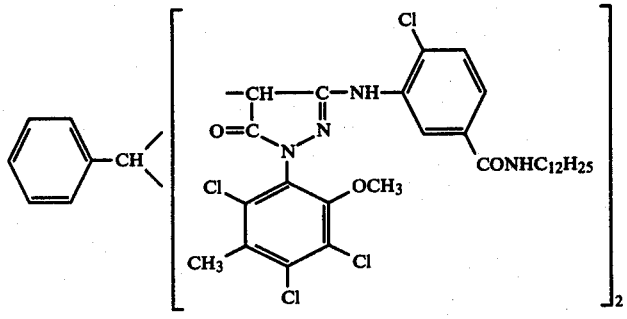

-continued
[M - 33]
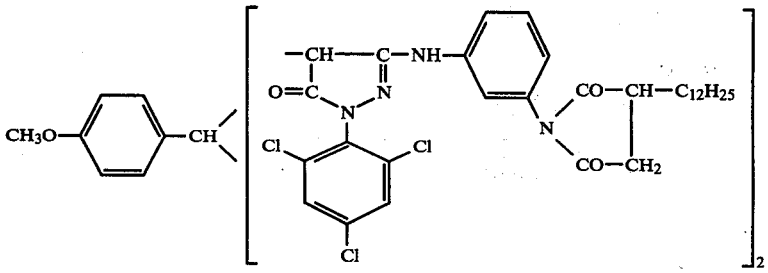
[M - 34]
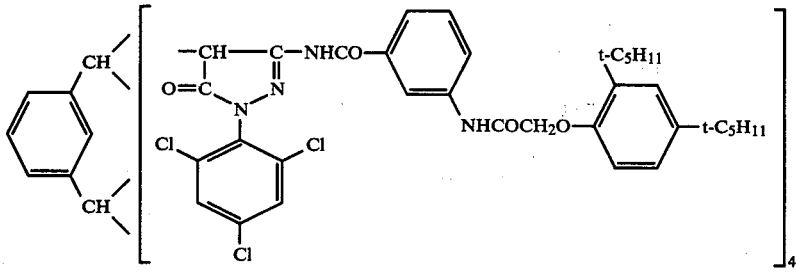
[M - 35]
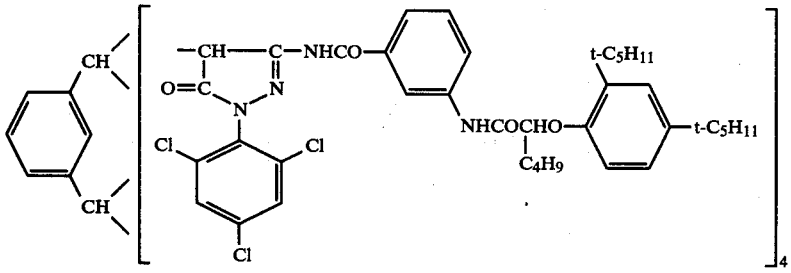
[M - 36]
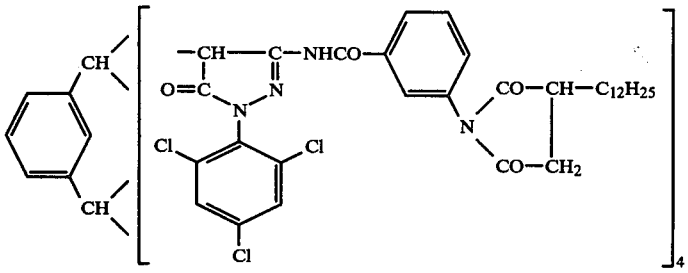
[M - 37]
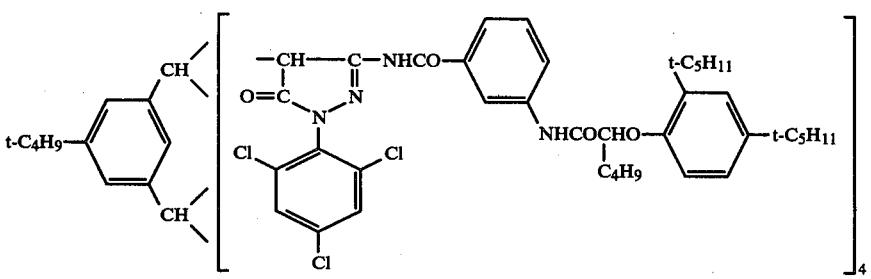

-continued

[M - 38]

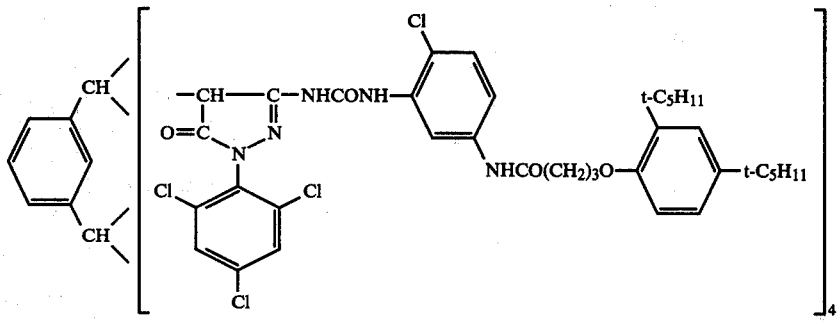

[M - 39]

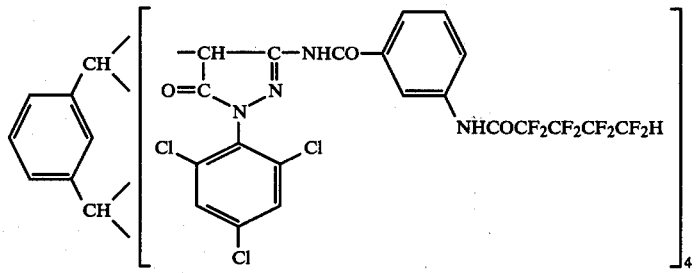

[M - 40]

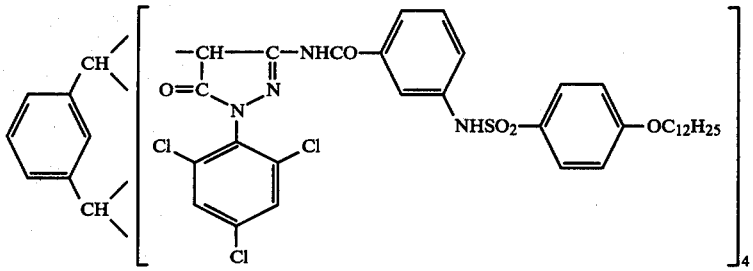

[M - 41]

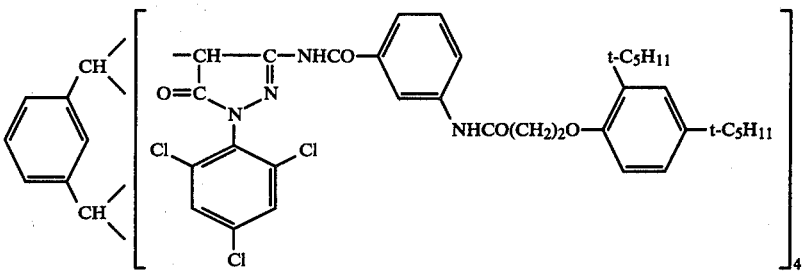

[M - 42]

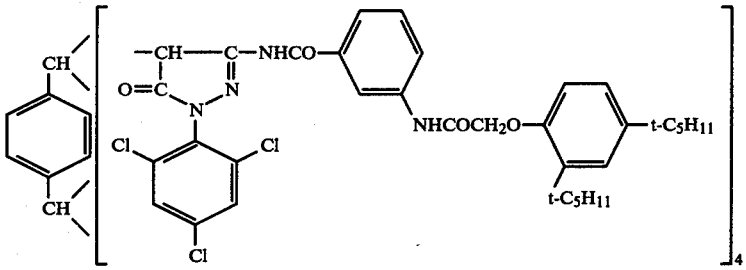

The magenta couplers used in the present invention also includes those described for example in U.S. Pat. Nos. 3,311,476, 3,419,391, 3,888,680 and 2,618,641, West German Offenlegungsschrift Nos. 20 15 814, 23 57 105 and 23 57 122, Japanese Provisional Patent Publication Nos. 129538/1974, 105820/1976, 12555/1979, 48540/1979, 112342/1976, 112343/1976, 108842/1976 and 58533/1977. The methods of preparing them are also described in these litaratures.

As for the coupler used in the present invention, it is preferable that the speed of the reaction between the coupler and the oxidized product of the developing agent is high because in this case the number of dye molecules formed per unit amount of developed silver increases. Particularly, couplers exhibiting a specific rate, as measured by the method described below, which is higher than that of the compound M-1 are preferable.

(Measurement of specific rate)

In 30 ml of ethyl acetate and 15 ml of dibutyl phthalate, 0.02 mole of a coupler is dissolved. The solution thus obtained is mixed with 20 ml of a 10% aqueous solution of Alkanol B (alkylnaphthalenesulfonate available from du Pont) and 200 ml of a 5% aqueous gelatin solution. The mixture is then emulsified and dispersed in a colloid mill. The dispersion thus obtained is then added to a silver iodobromide emulsion containing 3.5 mole % of silver iodide so that the mole percentage of the coupler with respect to silver in the emulsion is 10%. The composition thus obtained is then applied to a triacetate film so that the silver amount is 15 mg/dm$^2$, and dried to yield a specimen. The obtained specimen is exposed through an optical wedge and processed according to the processes described below by using the processing solutions described below.

The percentage of the maximum density obtained with a color developing solution containing citrazinic acid with respect to the maximum density obtained with a color developing solution containing no cirtazinic acid is taken as the specific rate.

| Processing (processing temperature: 38° C.) | Processing time |
|---|---|
| Color development | 3 minutes 15 seconds |
| Bleaching | 6 minutes 30 seconds |
| Washing with water | 3 minutes 15 seconds |
| Fixing | 6 minutes 30 seconds |
| Washing with water | 3 minutes 15 seconds |
| Stabilization | 1 minute 30 seconds |
| Drying | |

Compositions of the processing solutions were used in the processing steps:

| (Developing solution containing no citrazinic acid) | |
|---|---|
| 4-Amino-3-methyl-N—ethyl-N—(β-hydroxyethyl)-aniline sulfate | 4.75 g |
| Anhydrous sodium sulfite | 4.25 g |
| Hydroxylamine half-sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |

Made up to 1 liter with water, and adjusted to pH 10.3 with a IN aqueous potassium hydroxide or acetic acid.

(Developing solution containing citrazinic acid)

Citrazinic acid is added to the developing solution containing no citrazinic acid in an amount of 5 g per liter, and the resulting solution is adjusted to pH 10.3.

| (Bleaching solution) | |
|---|---|
| Ferric ammonium salt of ethylenediaminetetraacetic acid | 100.0 g |
| Diammonium salt of ethylenediaminetetraacetic acid | 10.0 g |
| Ammonium bromide | 150.0 g |
| Glacial acetic acid | 10.0 ml |
| Made up to 1 liter with water and adjusted to pH 6.0 with aqueous ammonia. | |
| (Fixing solution) | |

-continued

| | |
|---|---|
| Ammonium thiosulfate | 175.0 g |
| Anhydrous sodium sulfite | 8.6 g |
| Sodium metasulfite | 2.3 g |
| Made up to 1 liter with water and adjusted to pH 6.0 with acetic acid. | |
| (Stabilizing solution) | |
| Formalin (37% aqueous solution) | 1.5 ml |
| Konidax (available from Konishiroku Photo Industry Co., Ltd.) | 7.5 ml |
| Made up to 1 liter with water. | |

In the light-sensitive color photographic material in accordance with the present invention, it is preferable that at least one of the light-sensitive layers contain a compound releasing a development inhibitor by the reaction with an oxidized product of the color developing agent. By using such a compound, the sharpness, graininess, color purity and wide latitude of exposure are remarkably improved over the conventional light-sensitive color photographic material.

Examples of known compounds releasing a development inhibitor by the the reaction with an oxidized product of the developing agent are compounds which couple with an oxidized product of a color developing agent to form a dye and release a development inhibitor (hereinafter referred to as the DIR couplers) as disclosed in U.S. Pat. Nos. 3,148,062 and 3,227,554, and compounds which release a development inhibitor without forming a dye by the coupling with an oxidized product of a color developing agent (hereinafter referred to as the DIR substances) as disclosed in U.S. Pat. No. 3,632,345. (Both DIR couplers and DIR substances are referred to as the DIR compounds.)

For example, when the present invention is applied to an ordinary multi-layer light-sensitive color photographic material containing a blue-, green- and red-sensitive emulsion layers, the DIR compounds should be contained in one or more of these layers. Particularly, it is preferable that they are contained at least in the green-sensitive emulsion layer. Further, when an emulsion layer exhibiting a color sensitivity comprises a plurality of layers exhibiting different sensitivities as in the present invention, the DIR compounds should be contained in at least one of the layers, preferably in the emulsion having a lower sensitivity.

The DIR compounds preferably used in the present invention are represented by the following general formula (I) or (II):

A-TIME-Z (I)

In the general formula (I), A designates a coupling component capable of reacting with an oxidized product of a color developing agent. The coupling component may be any component which can release the group TIME-Z by the reaction with an oxidized product of a color developing agent.

In the general formula (I), TIME designates a timing group, and Z designates a development inhibitor. Examples of the timing groups includes those based on the intramolecular nucleophilic substitution as described in Japanese Provisional Patent Publication No. 145135/1979, and those based on the electron movement along the conjugated chain as described in Japanese Provisional Patent Publication No. 17644/1980. In short, any compound may be used if it first releases the group TIME-Z through the breakage of the A-TIME bond and then releases Z through the breakage of the TIME-Z bond. Z includes the development inhibitors as described in "Research Disclosure", Vol. 176, No. 17643, Dec. 1978 (hereinafter referred to as the literature 1). Preferably, it is mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole or a derivative thereof.

A-Z (II)

In the general formula (II), A and Z have the same meanings as described above with respect to the general formula (I).

Syntheses of the compounds represented by the general formula (I) are described for example in Japanese Provisional Patent Publication Nos. 14513/1979 and 17644/1980.

The DIR compounds represented by the general formula (II) involve the DIR couplers and the DIR substances. Examples of the DIR couplers represented by the general formula (II) are described e.g. in U.S. Pat. Nos. 3,227,554 and 3,773,201, and British Pat. No. 2,010,818. Syntheses thereof are also described in these patents.

Examples of the DIR substances represented by the general formula (II) are described e.g. in U.S. Pat. Nos. 3,958,993, 3,961,959 and 3,938,996, Japanese Provisional Patent Publication Nos. 147716/1975, 152731/1975, 105819/1976, 6724/1976 and 123025/1975, U.S. Pat. Nos. 3,928,041 and 3,632,345, and Japanese Provisional Patent Publication No. 125202/1975. Syntheses thereof are also described in these specifications.

[D-1]

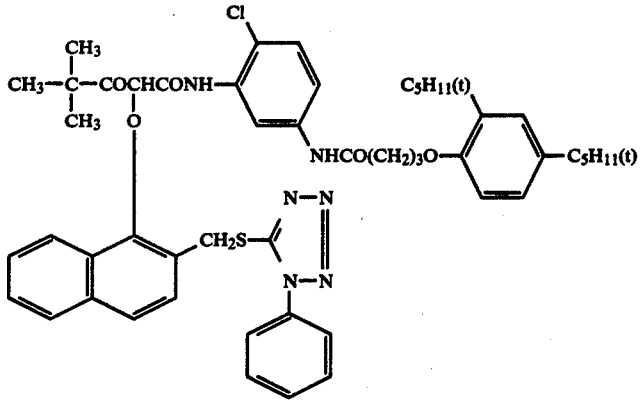

[D-2]

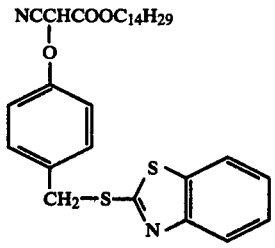

[D-3]

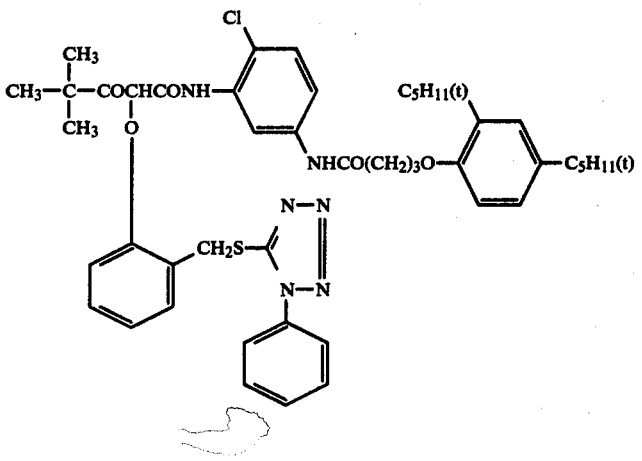

-continued
[D-4]
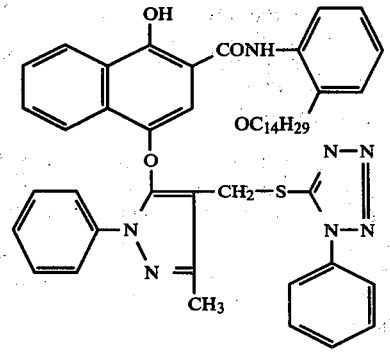
[D-5]
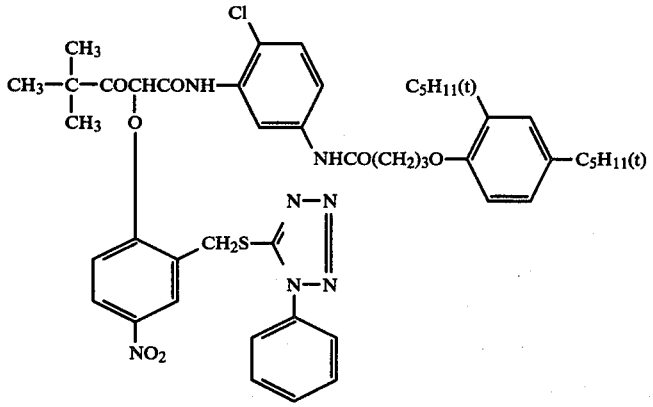
[D-6]
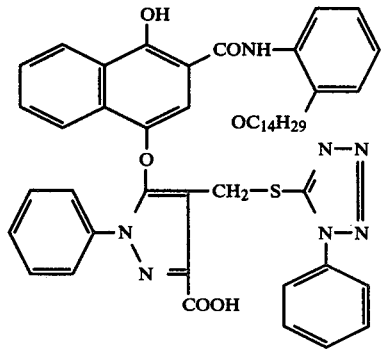
[D-7]
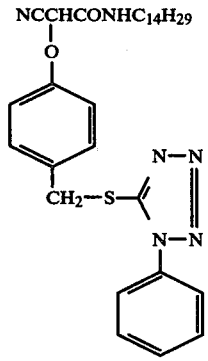

-continued
[D-8]
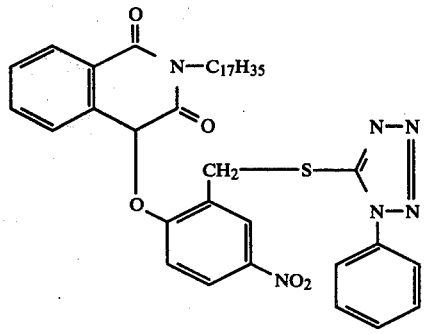
[D-9]
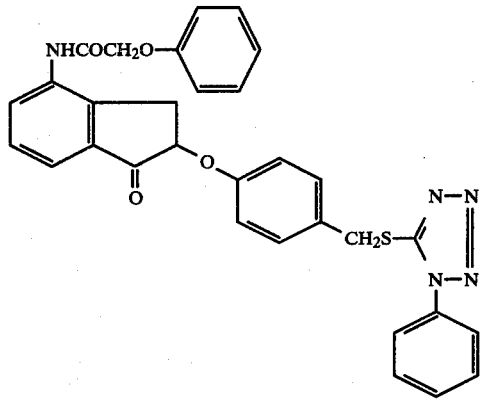
[D-10]
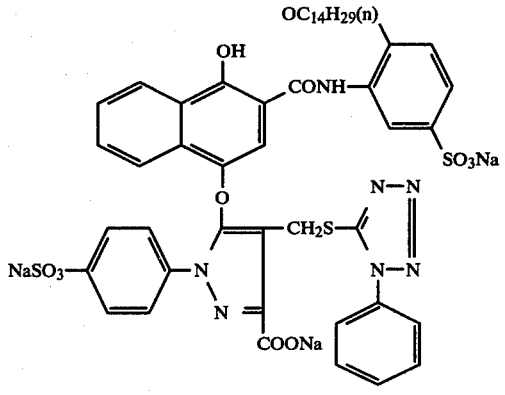
[D-11]
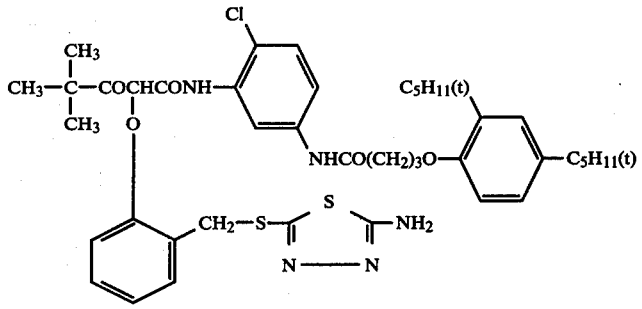

-continued
[D-12]
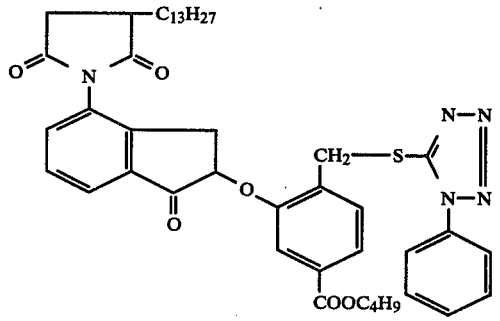
[D-13]
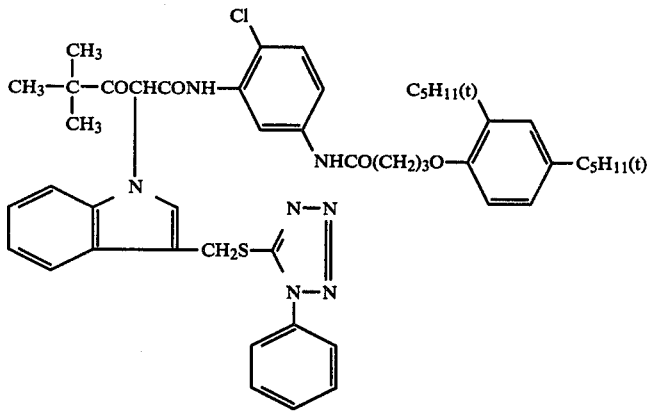
[D-14]
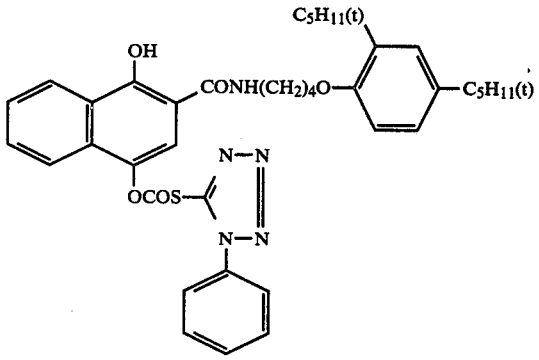
[D-15]
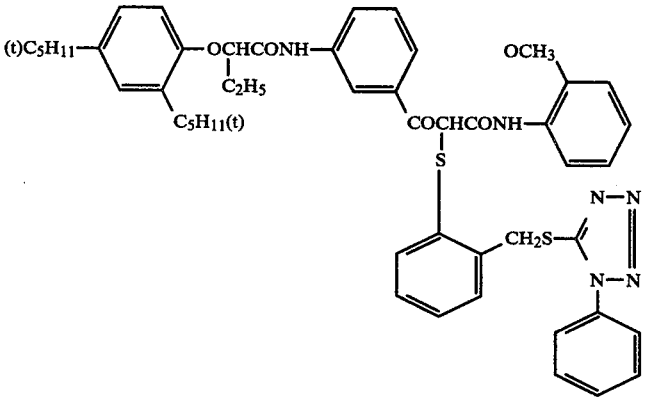

-continued
[D-16]
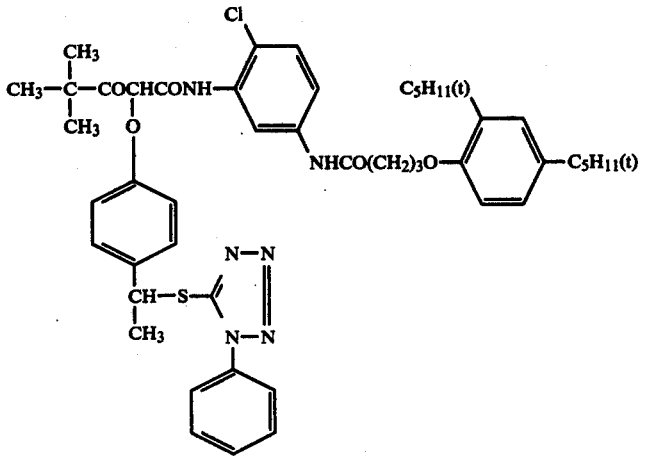
[D-17]
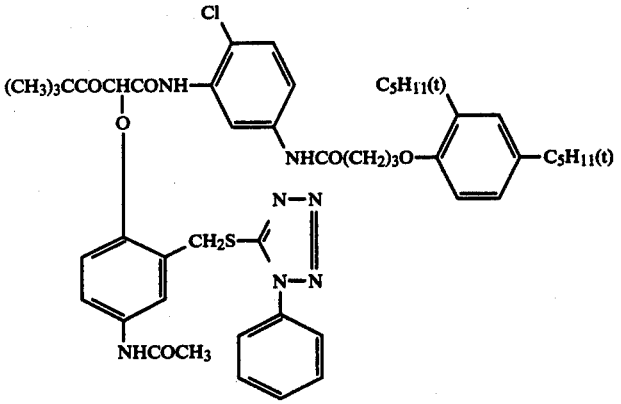
[D-18]
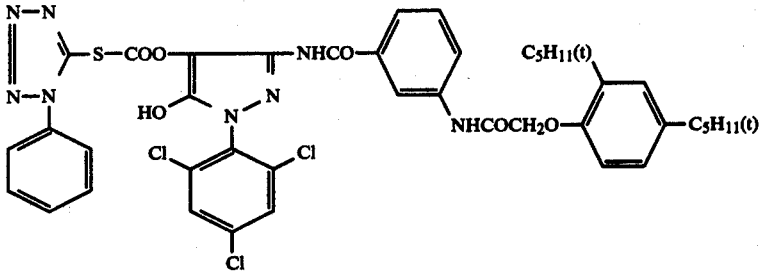
[D-19]
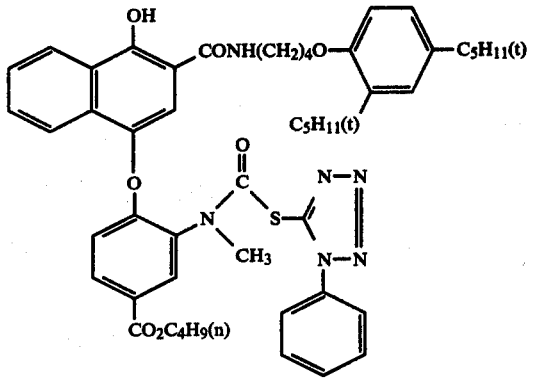

-continued
[D-20]
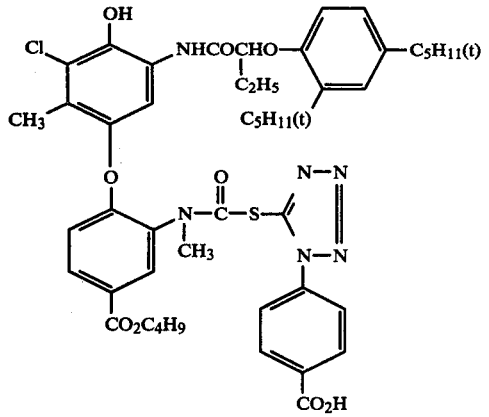
[D-21]
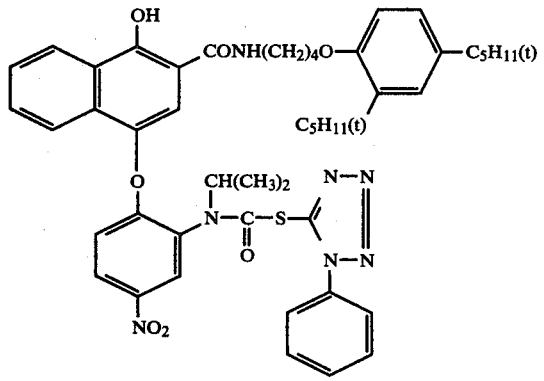
[D-22]
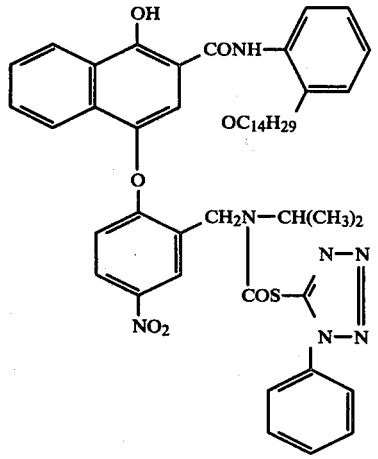

-continued

[D-23]

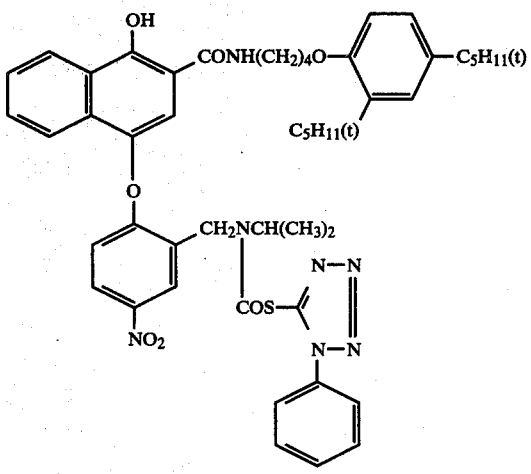

[D-24] ~ [D-31]

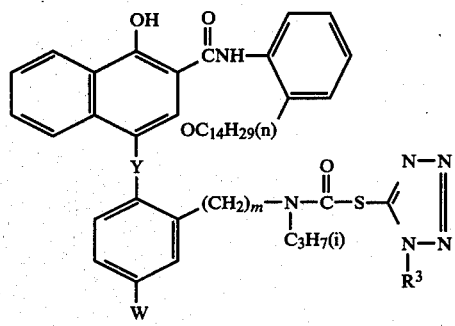

In the formula for [D-24]~[D-31], Y, W, m and $R^3$ each represent the following:

| Compound No. | Y | W | m | $R_3$ |
|---|---|---|---|---|
| [D-24] | O | $NO_2$ | O | 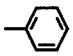 |
| [D-25] | S | $NO_2$ | 1 | 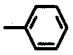 |
| [D-26] | O | $NO_2$ | 1 | 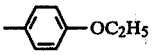 $OC_2H_5$ |
| [D-27] | O | $NO_2$ | 1 | 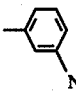 $NHCOCH_3$ |
| [D-28] | O | $NO_2$ | 1 | 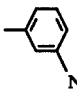 $NHCOC_3H_7$ |
| [D-29] | O | $-NHSO_2C_4H_9$ | O | 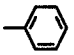 |

-continued

| Compound No. | Y | W | m | $R_3$ |
|---|---|---|---|---|
| [D-30] | O | $-NHSO_2C_8H_{17}$ | 1 | 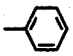 |
| [D-31] | S | H | O | 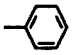 |
| [D-32] ~ [D-36] | | 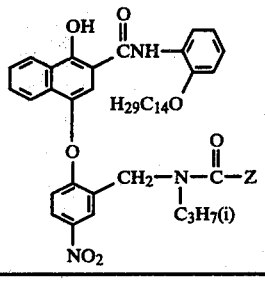 | | |

In [D-32]~[D-36], Z represents the following:

Compound No.

[D-32]ethylthiotetrazole
[D-33]n-butylthiotetrazole
[D-34]cyclohexylthiotetrazole
[D-35]N-butylthiotetrazole
[D-36]5,6-dichlorobenzotriazole

[D-37]
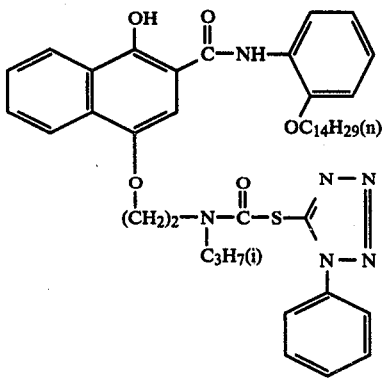
[D-38]
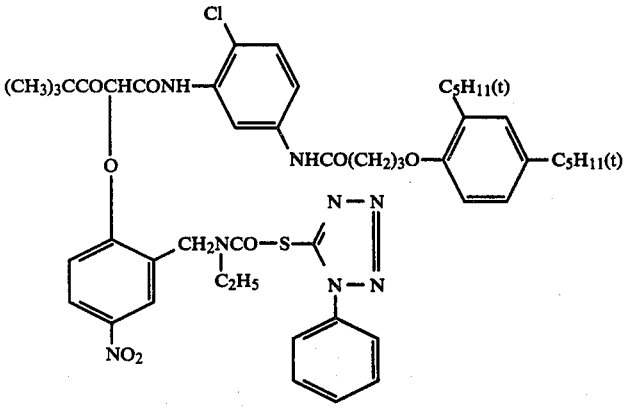
[D-39]
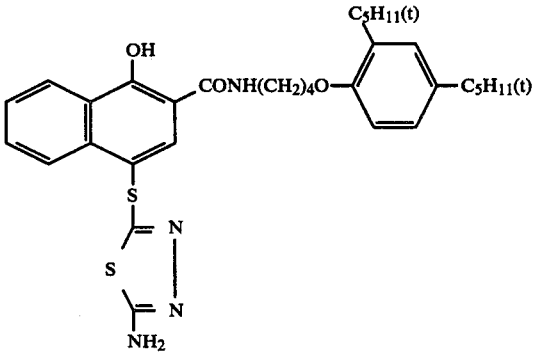
[D-40]
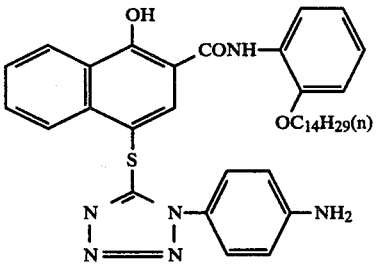

-continued
[D-41]
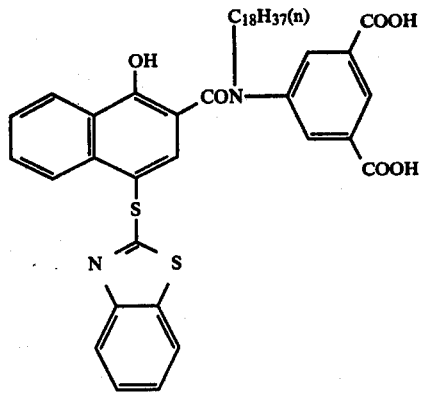
[D-42]
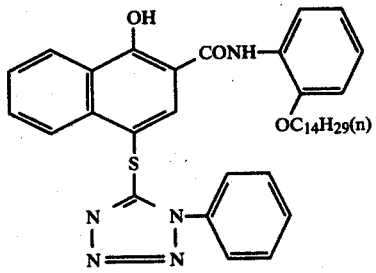
[D-43]
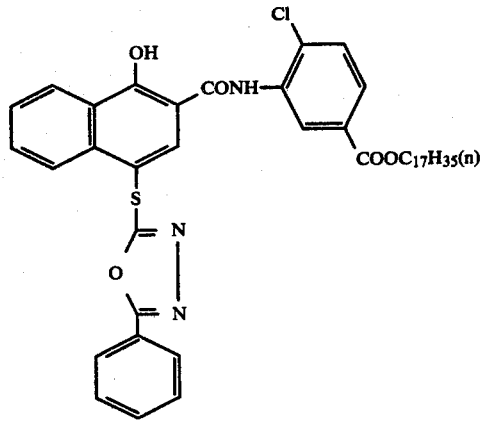
[D-44]
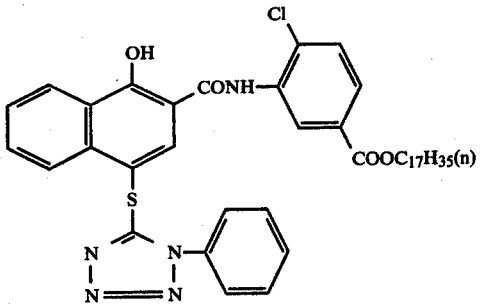

-continued
[D-45]
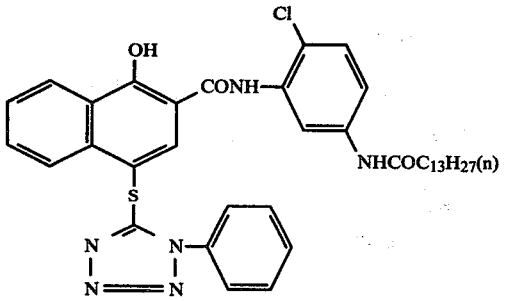
[D-46]
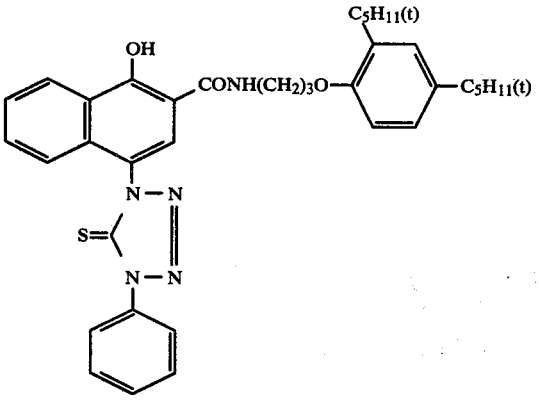
[D-47]
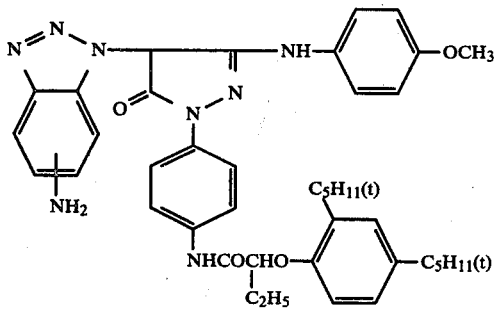
[D-48]
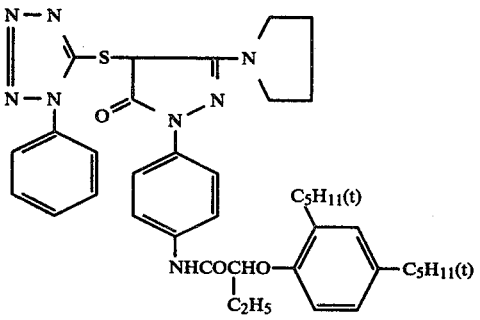
[D-49]
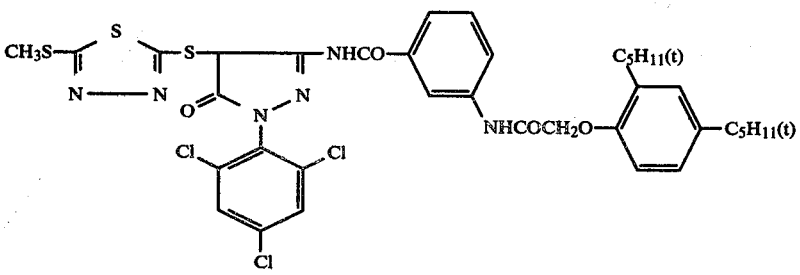

-continued
[D-50]
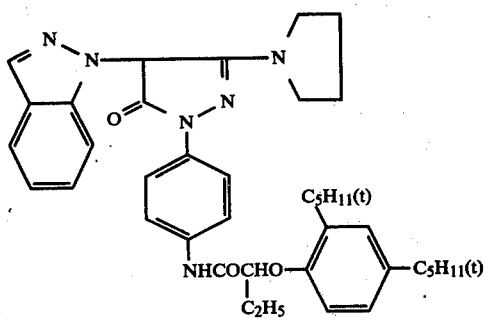
[D-51]
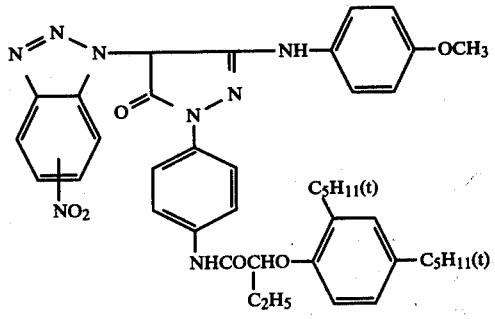
[D-52]
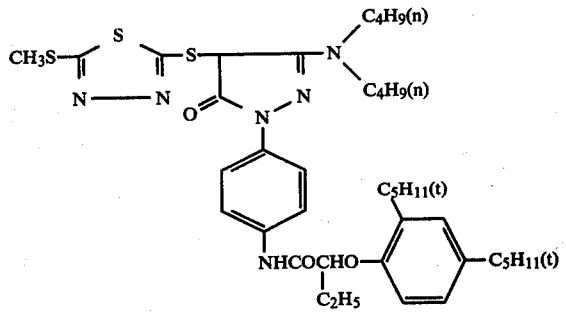
[D-53]
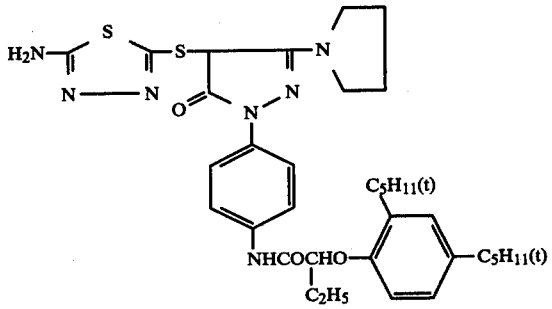
[D-54]
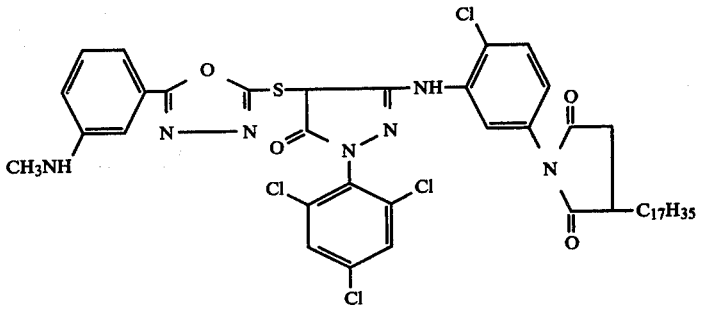

-continued
[D-55]
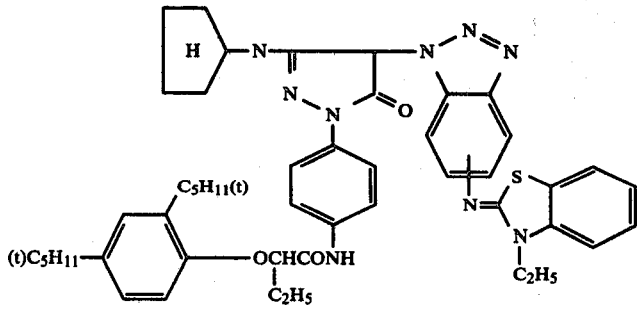
[D-56]
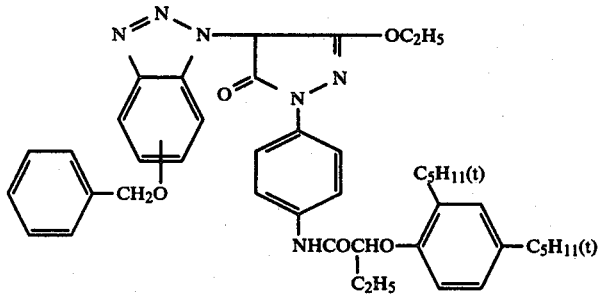
[D-57]
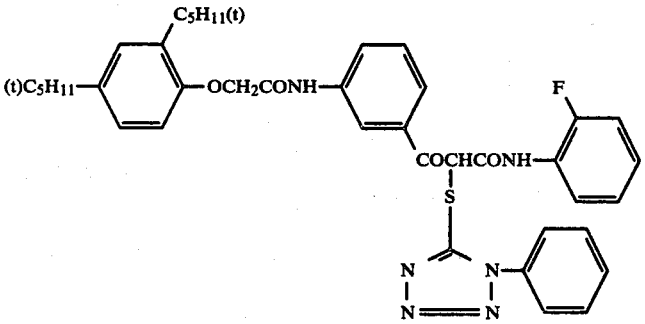
[D-58]
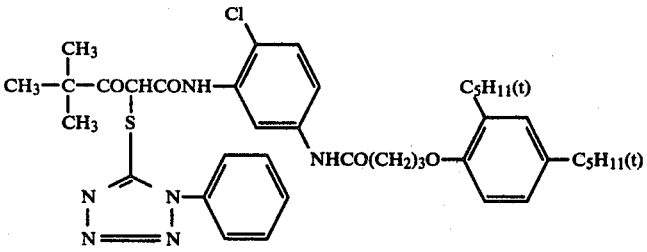
[D-59]
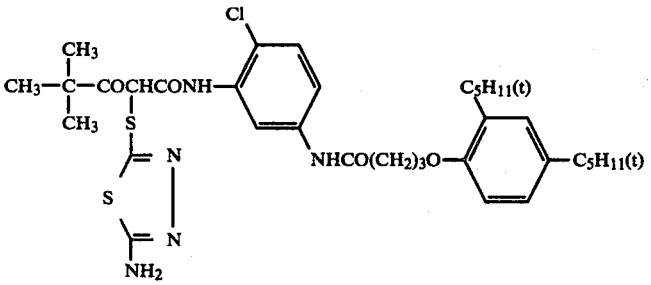

-continued
[D-60]
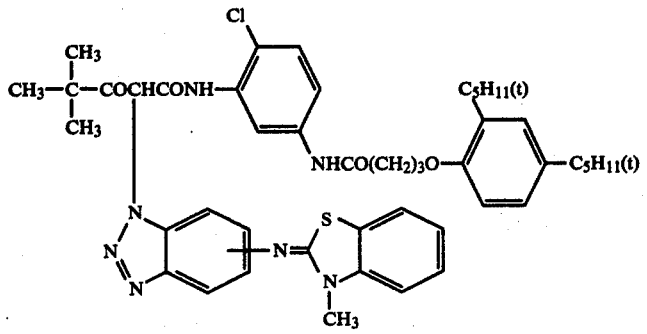
[D-61]
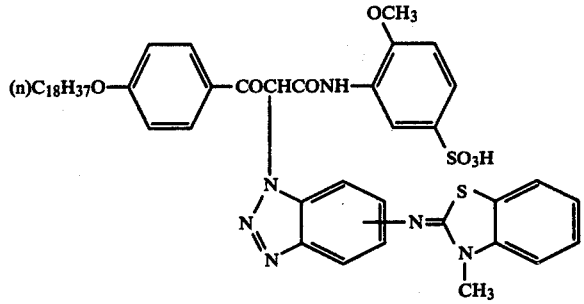
[D-62]
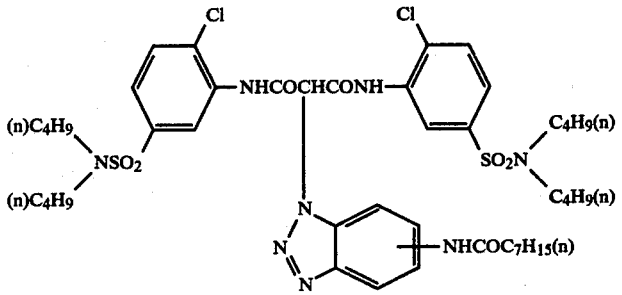
[D-63]
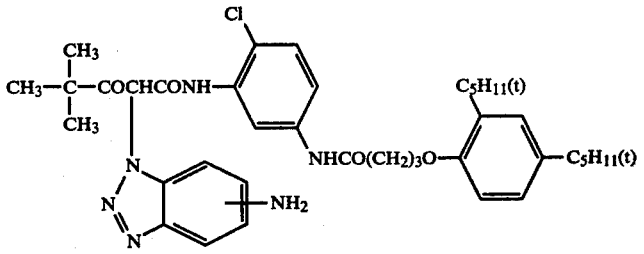
[D-64]
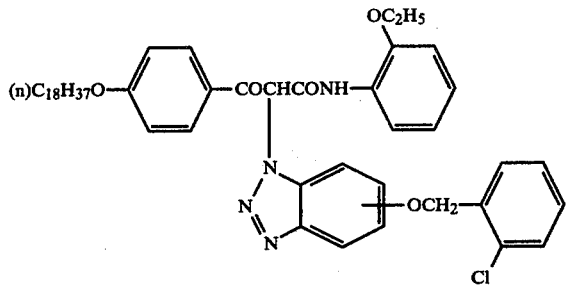

-continued
[D-65]
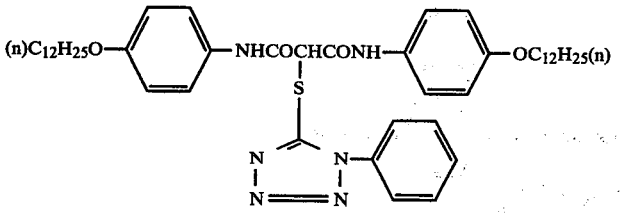
[D-66]
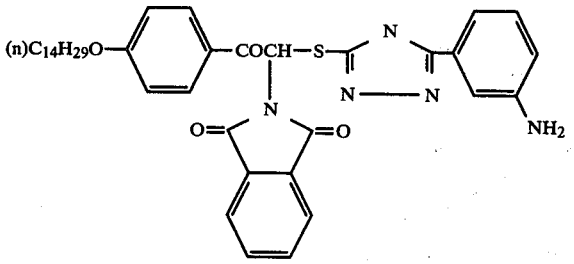
[D-67]
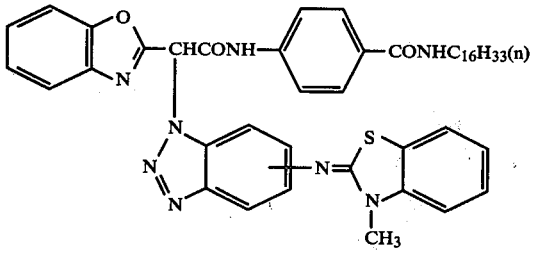
[D-68]
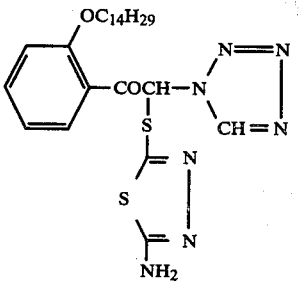
[D-69]
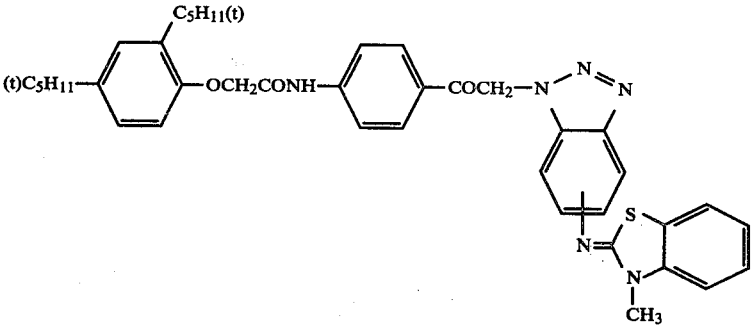

-continued
[D-70]
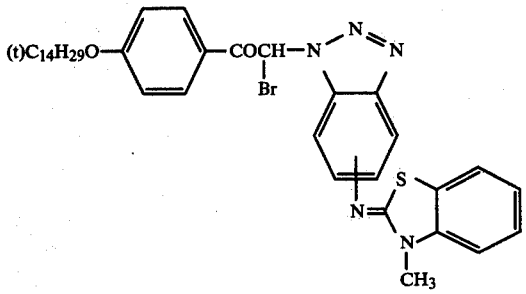
[D-71]
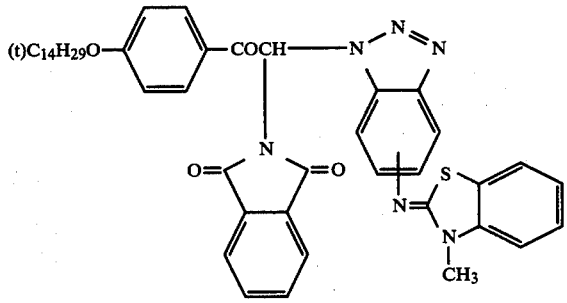
[D-72]
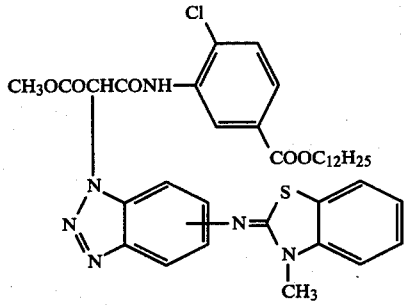
[D-73]
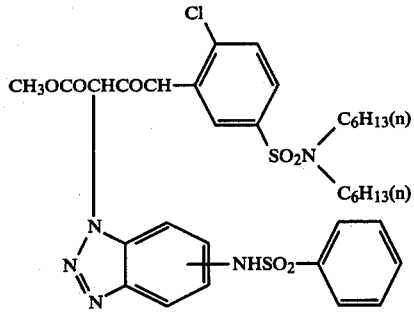
[D-74]
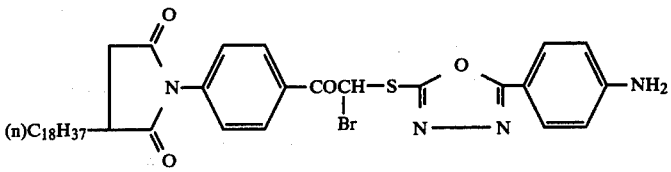
[D-75]
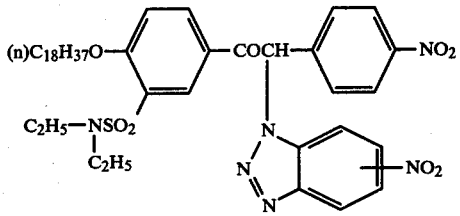

-continued
[D-76]
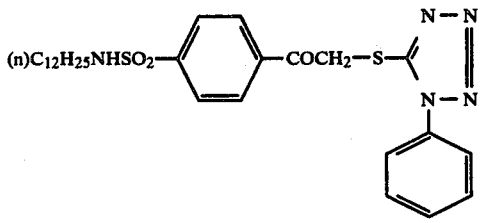
[D-77]
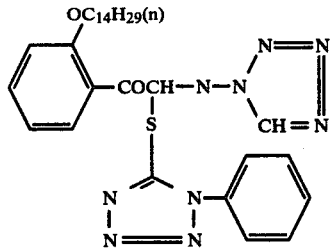
[D-78]
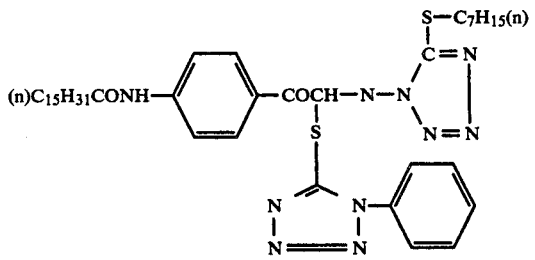
[D-79]
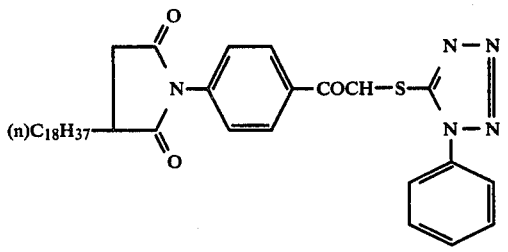
[D-80]
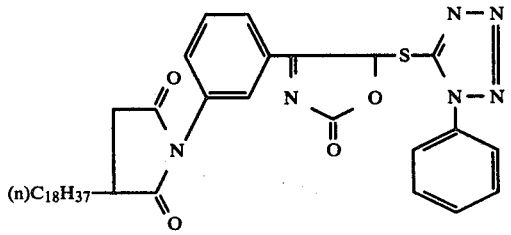
[D-81]
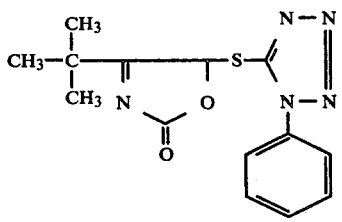

-continued
[D-82]
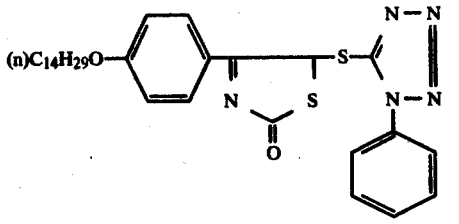
[D-83]
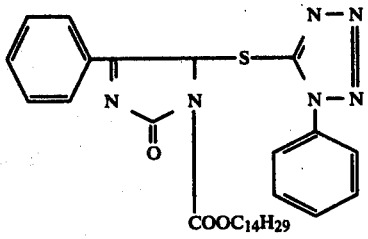
[D-84]
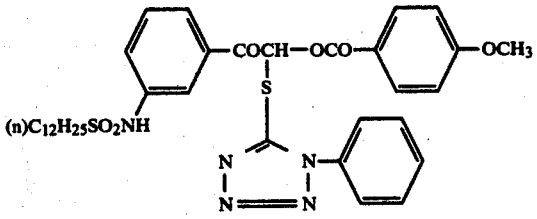
[D-85]
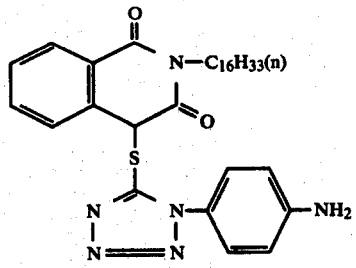
[D-86]
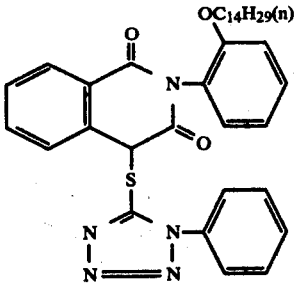
[D-87]
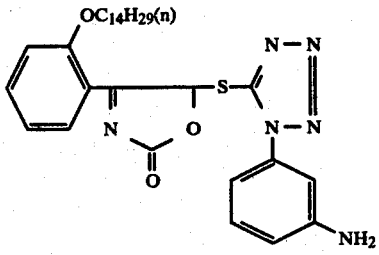
[D-88]
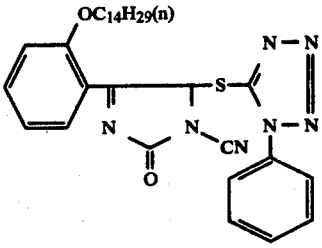
[D-89]
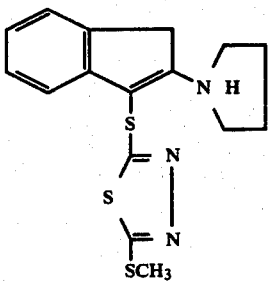
[D-90]
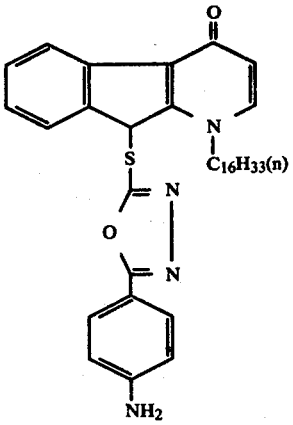

-continued
[D-91]
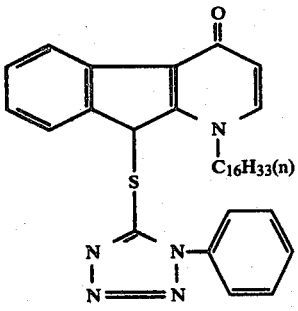
[D-92]
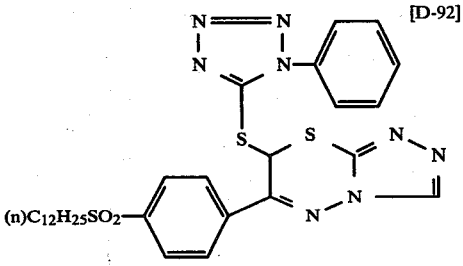
[D-93]
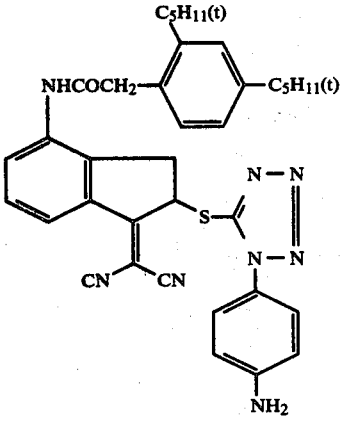
[D-94]
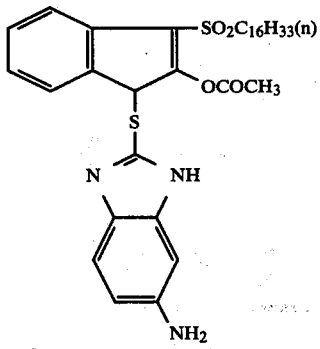
[D-95]
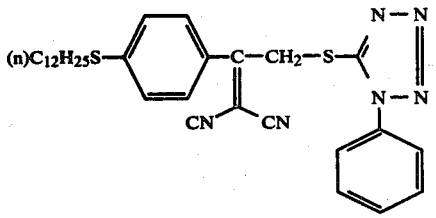
[D-96]
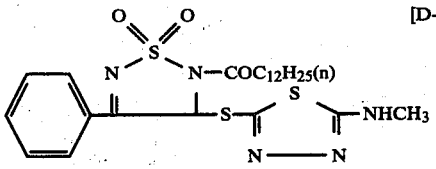
[D-97]
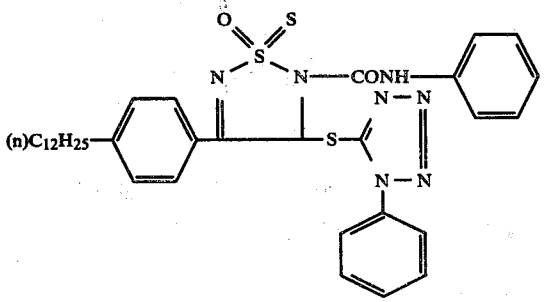
[D-98]
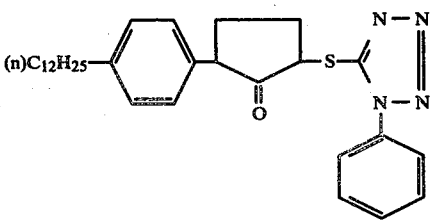

-continued
[D-99]
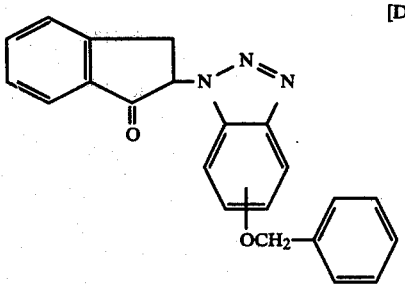
[D-100]
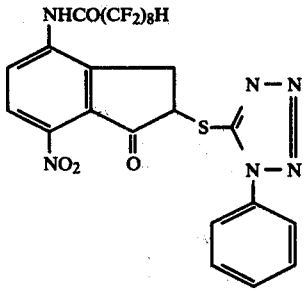
[D-101]
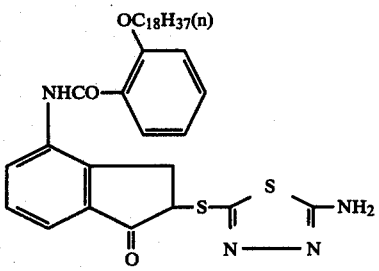
[D-102]
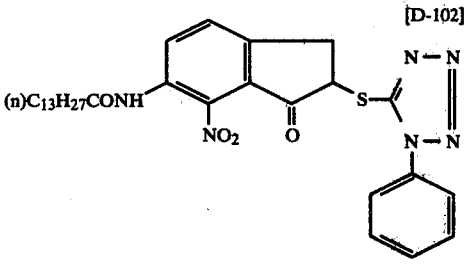
]D-103]
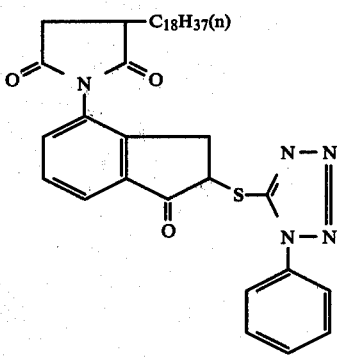
[D-104]
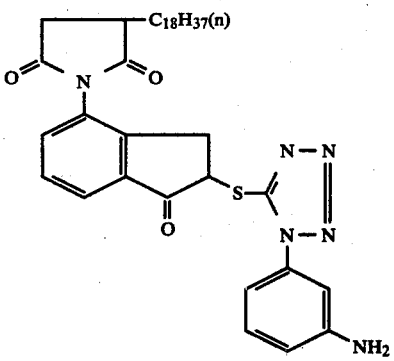
[D-105]
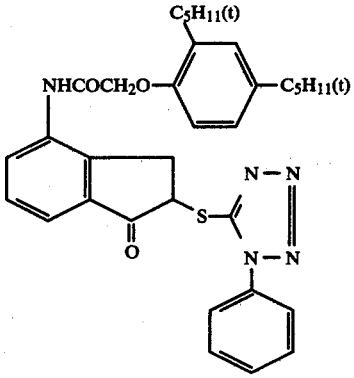
[D-106]
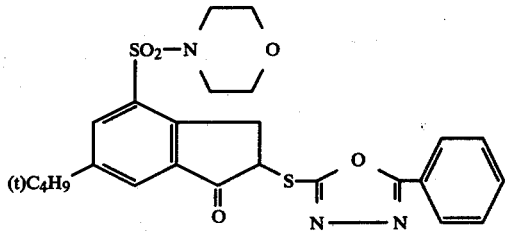

-continued
[D-107]
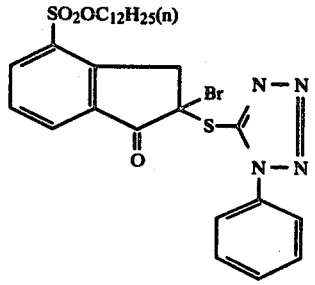
[D-108]
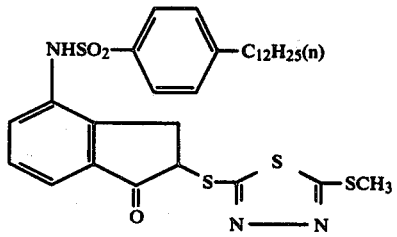
[D-109]
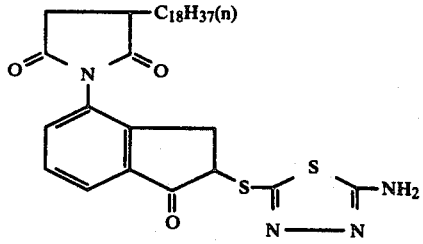
[D-110]
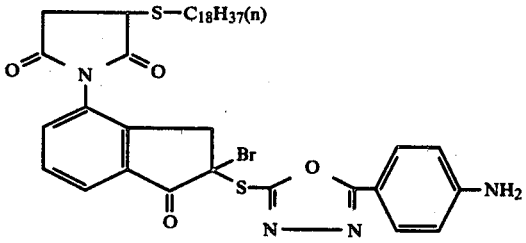
[D-111]
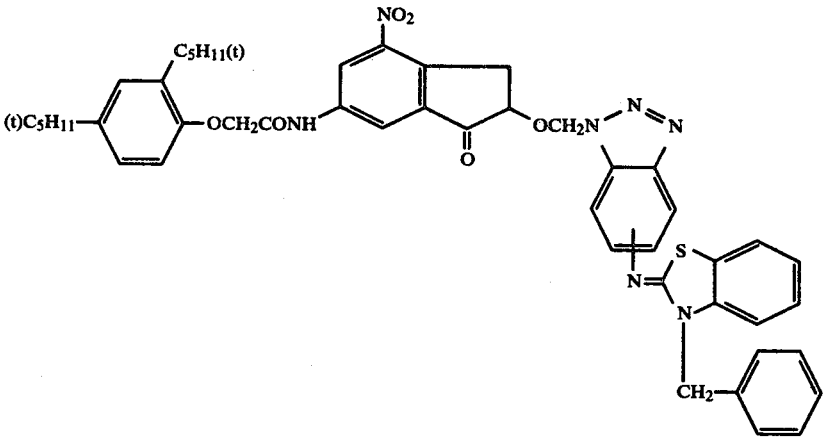

-continued
[D-112]
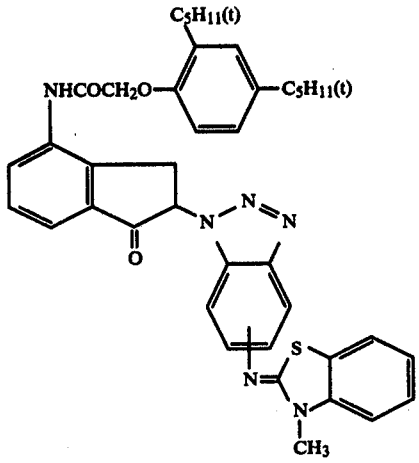
[D-113]
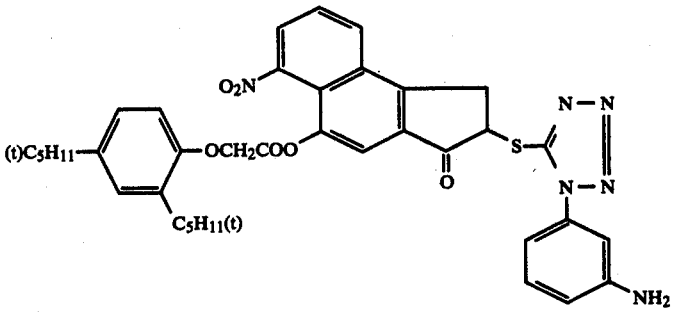
[D-114]
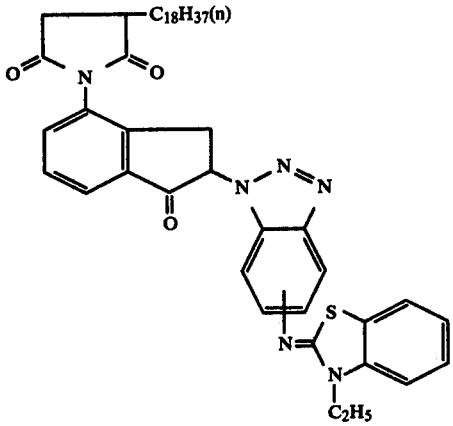
[D-115]
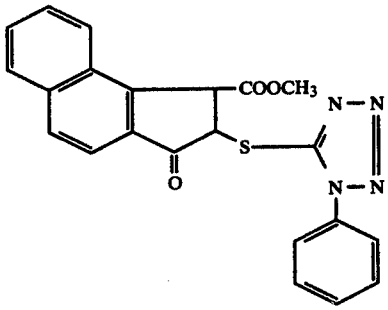

-continued
[D-116]
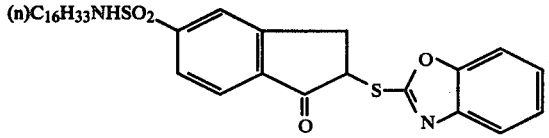
[D-117]
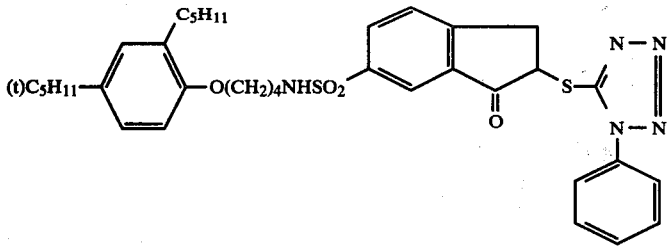
[D-118]
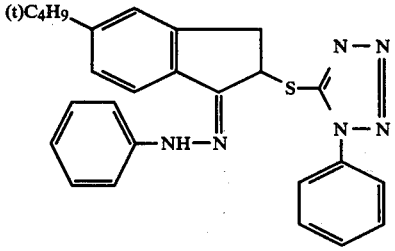
[D-119]
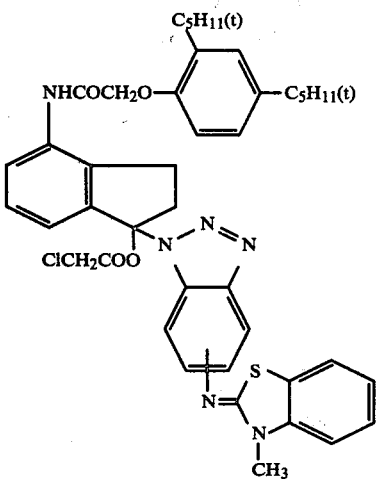
[D-120]
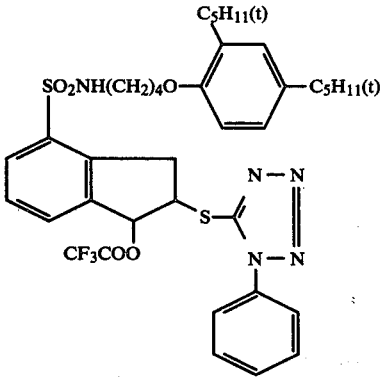

-continued

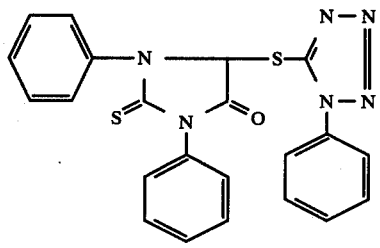

[D-121]

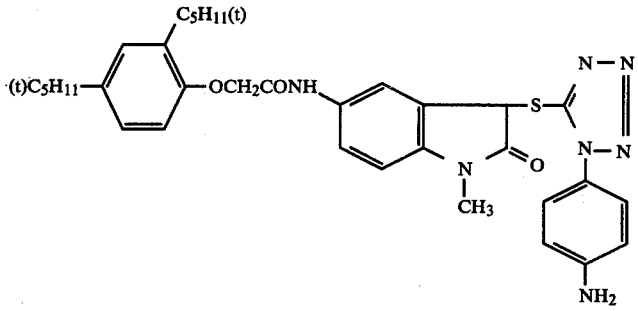

[D-122]

The other compositions of the silver halide light-sensitive color photographic material in accordance with the present invention may be determined as described in the above-mentioned literature 1 or "Research Disclosure" No. 18431.

The silver halide light-sensitive color photographic material in accordance with the present invention is highly sensitive and used for photographing purposes, for example, for color negative films, color reversal films, 8 mm color films, motion picture films and the like.

The light-sensitive color photographic material in accordance with the present invention can yield a color image by ordinary color development process following exposure. The basic processes in the negative-positive method include the color development, bleaching, and fixing processes. The basic processes of the reversal method include development with a black and white negative developing solution, followed by exposure to white light or treatment with a processing solution containing fogging agent, color development, bleaching and fixing. These basic processes are conducted independently or, two or more basic processes are conducted in one step using a processing solution having the respective functions. For example, a combined color processing method is conduced by using a processing solution containing a color developing agent, a ferric salt bleaching constituent and a thiosulfate fixing constituent, and a combined bleaching and fixing method is conducted by using a processing solution containing iron (III) complex of ethylenediaminetetraacetic acid as the bleaching constituent and a thiosulfate fixing constituent.

The light-sensitive color photographic material in accordance with the present invention may be processed by any processing method consisting for example of color development, combined bleaching and fixing, if necessary followed by washing and stabilization; color development, bleaching, fixing, if necessary followed by washing and stabilization; pre-hardening, neutralization, color development, combined stopping and fixing, washing, bleaching, fixing, washing, post-hardening, and washing; color development, washing, subsidiary color development, stopping, bleaching, fixing, washing, and stabilization; pre-hardening, neutralization, washing, first development, stopping, washing, color development, stopping, washing, bleaching, fixing, and washing; pre-hardening, neutralization, first development, stopping, washing, color development, stopping, washing, bleaching, organic acid bath, fixing, and washing; first development, non-fixing silver dye bleaching and washing, color development, acid rinsing, washing, bleaching, washing, fixing, washing, stabilization, and washing; halogenation belaching of developed silver generated by color development, followed by color development to increase the amount of dye formed; or processing of a low-silver light-sensitive material with an amplifier such as peroxide or cobalt complex.

Typical examples of the color developing agents used in the developing solution are aromatic primary amino compounds such as p-phenylenediamines and p-aminophenols. The typical examples of these compounds are:

N,N-Dimethyl-p-phenylenediamine, N,N-diethyl-p-phenylenediamine, 3-methyl-N,N-diethyl-p-phenylenediamine, N-carbamidemethyl-N-methyl-p-phenylenediamine, N-carbamidemethyl-N-tetrahydrofurfuryl-2-methyl-p-phenylenediamine, N-ethyl-N-carboxymethyl-2-methyl-p-phenylenediamine, N-carbamidemethyl-N-ethyl-2-methyl-p-phenylenediamine, 3-β-methanesulfonamidoethyl-4-amino-N,N-diethylaniline, N-ethyl-N-tetrahydrofurfuryl-2-methyl-p-aminophenol, 3-acetylamino-4-aminodimethylaniline, 3-methyl-4-amino-N-ethyl-N-β-hydroxyethylaniline, N-ethyl-N-β-methanesulfonamidoethyl-4-aminoaniline, 3-methyl-4-amino-N-ethyl-N-β-methanesulfonamidoethylaniline, N-ethyl-N-β-methanesulfonamidoethyl-3-methyl-4-aminoaniline, 3-methyl-4-amino-N-ethyl-N-β-methoxyethylaniline, N-methyl-N-β-sulfoethyl-p-phenylenediamine, N-ethyl-N-β-(β-methoxyethoxy)ethyl-3-methyl-4-aminoaniline, N-ethyl-N-β-[β-(β-methoxyethoxy)ethoxy]-ethyl-3-methyl-4-aminoaniline, o-aminophenol, p-aminophenol, 5-amino-2-oxy-toluene inorganic acid salt such as hydrochloric acid or sulfuric acid, or organic acid salt such as p-toluenesulfonate and the like.

Typical examples thereof are also described in Japanese Provisional Patent Publication Nos. 64932/1973, 131526/1975 and 95849/1976, and by Bent et al. in "Journal of the American Chemical Society", Vol. 73, pages 3100–3125, 1951.

The amount of the aromatic primary amino compound used is determined by the desired activity of the developing solution. To increase the activity, the amount used should be raised. It is generally used in an amount between 0.0002 mol/liter and 0.7 mol/liter. According to the purposes, it is possible to use a combination of two or more compounds, for example, 3-methyl-4-amino-N,N-diethylaniline and 3-methyl-4-amino-N-ethyl-N-β-methanesulfonamidoethylaniline; 3-methyl-4-amino-N-ethyl-N-β-methanesulfonamidoethylaniline and 3-methyl-4-amino-N-ethyl-N-β-hydroxyethylaniline; 3-methyl-4-amino-N-ethyl-N-β-methanesulfonamidoethylaniline and N-ethyl-N-β-[β-(β-methoxyethoxy)ethoxy]ethyl-3-methyl-4-aminoaniline; 3-methyl-4-amino-N,N-diethylaniline and 3-methyl-4-amino-N-ethyl-N-β-methanesulfonamidoethyl- and 3-methyl-4-amino-N-ethyl-N-β-hydroxyethylaniline and N-ethyl-N-β-[β-(β-methoxyethoxy)ethoxy]ethyl-3-methyl-4-aminoaniline; 3-methyl-4-amino-N-ethyl-N-β-methanesulfonamidoethylaniline and 3-methyl-4-amino-N-β-methoxyethylaniline.

The color developing solution may further contain various constituents ordinarily used in such solutions, for example, alkali agents such as sodium hydroxide, sodium carbonate and potassium carbonate, alkali metal sulfite, alkali metal bisulfite, alkali metal thiocyanate, alkali metal halide, benzyl alcohol, water softening agent, thickening agent and development accelerator. The pH value of the color developing solution is normally 7 or more, most generally between about 9 and about 13.

Additives used as required in the color developing solution include for example hydroxides, carbonates, and phosphates of alkali metals and ammonium for keeping the pH value constant; pH adjusting or buffering agents (e.g. weak acids such as acetic acid and boric acid, weak bases, and their salts); development accelerators such as pyridinium compounds, cationic compounds, potassium nitrate and sodium nitrate, polyethylene glycol condensates, phenyl cellosolve, phenylcarbitol, alkyl cellosolve, phenylcarbitol, dialkylformamide, alkyl phosphate and derivatives thereof, nonionic compounds such as polythioethers, polymers having sulfite esters, organic amines such as pyridine and ethanolamine, benzyl alcohol and hydrazine.

Examples of fog restrainers include bromides such as potassium bromide, sodium bromide and ammonium bromide, compounds used for quick processing solutions such as alkali iodide, nitrobenzoimidazole, mercaptobenzoimidazole, 5-methylbenzotriazole, and 1-phenyl-5-mercaptotetrazole, nitro benzoate, benzothiazolium derivatives and phenazine N-oxide.

It is also possible to use stain preventing agents, sludge preventing agents, interlayer effect accelerators, preservatives (e.g. sulfite, acid sulfite, hydroxylamine hydrochloride, formsulfite, alkanolamine sulfite adduct), and chelating agents.

Examples of the chelating agents are phosphates such as polyphosphates, aminopolycarboxylic acids such as nitrilotriacetic acid and 1-3-diamino-2-propanoltetraacetic acid, oxycarboxylic acids such as citric acid and gluconic acid, and 1-hydroxy-1,1'-diphosphonic acid. These chelating agents may be used in combination with each other or with lithium sulfate.

Metal complexes of organic acids used as the bleaching agent in the bleaching solution or in the combined bleaching and fixing solution oxidize the metallic silver formed by the development and convert it into silver halides, and at the same time cause the noncolor-forming portion of the color forming agent to develop color. The metal complexes of organic acids have a structure in which metal ions such as iron, cobalt and copper are coordinated with organic acids such as aminopolycarboxylic acid, oxalic acid or citric acid. The most preferable organic acids used for forming such metal complexes are aminopolycarboxylic acids represented by the general formulas (III) and (IV):

$$HOCO\text{-}A_1\text{-}Z\text{-}A_2\text{-}COOH \quad \text{(III)}$$

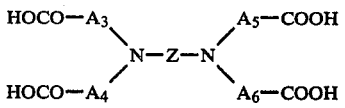

(IV)

in which $A_1$, $A_2$, $A_3$, $A_4$, $A_5$ and $A_6$ each designate a substituted or unsubstituted hydrocarbon group, and Z designates a hydrocarbon group, oxygen atom, sulfur atom or $>N\text{-}A_7$ wherein $A_7$ denotes a hydrocarbon group or a lower aliphatic carboxilic acid.

These aminopolycarboxylic acids may be used in the form of an alkali metal salt, an ammonium salt or a water-soluble amine salt. The typical examples of the aminopolycarboxylic acids represented by the general formulas (III) and (IV) and the other aminopolycarboxylic acids are:

Ethylenediaminetetraacetic acid,
diethylenetriaminepentaacetic acid,
ethylenediamine-N-(β-oxyethyl)-N,N',N'-triacetic acid,
propylenediaminetetraacetic acid,
nitrilotriacetic acid,
cyclohexanediaminetetraacetic acid,
iminodiacetic acid,
dihydroxyethylglycine,
ethyletherdiaminetetraacetic acid,
glycoletherdiaminetetraacetic acid,
ethylenediaminetetrapropionic acid,
phenylenediaminetetraacetic acid,
disodium ethylenediaminetetraacetate,
tetra(trimethylammonium)ethylenediaminetetraacetate,
tetrasodium ethylenediaminetetraacetate,
pentasodium diethylenetriaminepentaacetate,
sodium ethylenediamine-N-(β-oxyethyl)-N,N',N'-triacetate,
sodium propylenediaminetetraacetate,
sodium nitrilotriacetate, and
sodium cyclohexanediaminetetraacetate.

In addition to the above-mentioned metal complexes of organic acids as the bleaching agents, various additives may be contained in the bleaching solution. The additives may preferably be re-halogenating agents such as alkali halides and ammonium halides e.g. potassium bromide, sodium bromide, sodium chloride and ammonium bromide. It is also possible to add pH buffering agents such as borate, oxalate, acetate, carbonate and phosphate, and other additives which is usually used in bleaching solutions such as polyaminocarboxylic acids and their salts, alkylamines and polyethylene oxides.

When a combined bleaching and fixing solution (bleach-fixing solution) is used in the bleaching process, a bleach-fixing solution containing the above-mentioned metal complexes of organic acids as the belaching agents and silver halide fixing agents such as thiosulfates, thiocyanates and thioureas is used. The solution may also contain a small or large amount of halogen compounds such as potassium bromide. It is also possible to use a special bleaching and fixing solution consisting of a combination of a bleaching agent and a large amount of halogen compounds such as potassium bromide. The above-mentioned halogen compounds may be potassium bromide, hydrochloric acid, hydrobromic acid, lithium bromide, sodium bromide, ammonium bromide, potassium iodide and ammonium iodide.

Typical examples of the silver halide fixing agents contained in the bleach-fixing solution are the compounds forming water-soluble complexes by the reaction with silver halides, which are used in usual fixing, e.g. thiosulfates such as potassium thiosulfate, sodium thiosulfate and ammonium thiosulfate, thiocyanates such as potassium thiocyanate, sodium thiocyanate, and ammonium thiocyanates, or thioureas and thioethers.

Like a bleaching solution, the bleach-fixing solution may further contain pH buffering agents such as boric acid, borax, sodium hydroxide, potassium hydroxide, sodium carbonate, potassium carbonate, sodium bicarbonate, potassium bicarbonate, acetic acid, sodium acetate and ammonium hydroxide alone or in combination. The solution may also contain various brightening agents, anti-foaming agents and surface active agents. It is also possible to add preservatives such as bisulfite addition compounds of hydroxylamine, hydrazine, and aldehyde compounds, organic chelating agents such as aminopolycarboxylic acids, stabilizers such as nitroalcohol nitrate, organic solvents such as methanol, dimethylsulfoamide, and dimethylsulfoxide.

The silver halide fixing agents are the compounds forming water-soluble complexes by the reaction with silver halides, which are used in usual fixing. The typical examples thereof are thiosulfates such as potassium thiosulfate, sodium thiosulfate, and ammonium thiosulfate, thiocyanates such as potassium thiocyanate, sodium thiocyanate, and ammonium thiocyanate, or thioureas and thioethers. These agents may be used alone or in combination. In the latter case, they may be combined in any proportion. The halides of alkali metals or ammonium sometimes exhibit the fixing action.

The fixing solution may be incorporated with various additives as required, e.g. pH buffering agents such as boric acid, borax, sodium hydroxide, potassium hydroxide, sodium carbonate, potassium carbonate, sodium bicarbonate, potassium bicarbonate, acetic acid, sodium acetate and ammonium hydroxide alone or in combination. The solution may also contain various brightening agents, anti-foaming agents and surface active agents. It is also possible to add preservatives such as sulfurous acid, bisulfite addition compounds of hydroxylamine, hydrazine, and aldehyde compounds, organic chelating agents such as aminopolycarboxylic acids, stabilizers such as nitroalcohol nitrate, organic solvents such as methanol, dimethylsulfoamide, and dimethylsulfoxide. Conventional fixing accelerators may be added optionally.

The present invention is hereinafter illustrated by the following nonlimitative examples.

First, the preparations of the emulsions used in the examples are described below.

(Preparation of polydispersed emulsion)

An ammoniacal silver nitrate solution and an aqueous alkali halide solution were naturally dropped into a reactor containing an aqueous gelatin solution and an excess of halide and maintained at 60° C. Then after an aqueous Demool-N (made by KAO Atlas Co. Ltd.

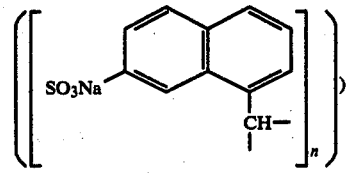

solution and aqueous magnesium sulfate solution were added to cause precipitation, desalting was done, and gelatin was added to obtain an emulsion having a pAg value of 7.8 and a pH value of 6.0. Further, sodium thiosulfate, chloroauric acid and ammonium thiocyanate were added, and the resulting mixture was subjected to chemical ripening at 52° C. for 70 minutes. Thereafter, 4-hydroxy-6-methyl-1,3,3a,7-tetrazaindene and 6-nitrobenzoimidazole were added, and gelatin was added to obtain a polydispersed silver iodobromide emulsion. The molar percentage of the silver iodide was changed by changing the composition of the alkali halide, and the average crystal size and crystal size distribution were changed by changing the time for adding the ammoniacal silver nitrate solution and the aqueous alkali halide solution.

(Preparation of monodispersed emulsion)

An aqueous ammoniacal silver nitrate solution and an aqueous potassium bromide solution were added to a reactor containing potassium iodide and an aqueous gelatin solution while the pAg value in the reactor was maintained constant. This addition was done in proportion to the increase in the surface area of crystals during the growth thereof. Then, after an aqueous Demool-N (made by KAO Atlas Co., Ltd.

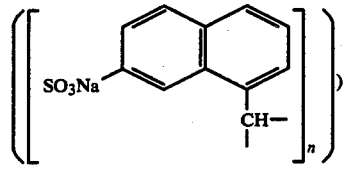

solution and aqueous magnesium sulfate solution were added to cause precipitation, desalting was done, and gelatin was added to obtain an emulsion having a pAg value of 7.8 and a pH value of 6.0. Further, sodium thiosulfate, chloroauric acid and ammonium thiocyanate were added, and the resulting mixture was subjected to chemical ripening. Thereafter, 4-hydroxy-6-methyl-1,3,3a,7-tetrazaindene and 6-nitrobenzoimidazole were added, and gelatin was further added to obtain a monodispersed silver iodobromide emulsion. The molar percentage of the silver iodide was changed by changing the ratio of potassium iodide to potassium bromide. The crystal size was changed by changing the amounts of the ammoniacal silver nitrate and the potassium halide added. Furthermore crystal shape was changed by varying the pAg value during a precipitation procedure, which however should be kept constant during the reaction.

EXAMPLE 1

Specimen No. 1 was prepared by sequentially applying the layers described below on a transparent support made of an under-coated cellulose triacetate film. (In all examples below, addition amount to the silver halide light-sensitive color photographic material is the amount per 1 $m^2$, and the amounts of the silver halide emulsion and the colloidal silver are expressed in terms of silver.)

(Specimen No. 1)

Layer 1: Antihalation layer containing 0.4 g of black colloidal silver and 3 g of gelatin.

Layer 2: Low-sensitivity red-sensitive emulsion layer containing 1.5 g of silver iodobromide low-sensitivity red-sensitive emulsion (obtained by red-sensitization of emulsion 2 in Table 2), 1.6 g of gelatin and 0.4 g of tricresyl phosphate (hereinafter referred to as TCP) in which 0.80 g of 1-hydroxy-4-[β-methoxyethylaminocarbonylmethoxy)-N-[δ-(2,4-di-tert-amylphenoxy)butyl]-2-naphthoamide (hereinafter referred to as cyan coupler C-18), and 0.028 g of 1-hydroxy-4-[4-(1-hydroxy-8-acetamido-3,6-disulfo-2-naphthylazo)phenoxy]-N-[δ-(2,4-di-tert-amylphenoxy)butyl]-2-naphthoamide disodium salt (hereinafter referred to as colored cyan coupler CC-1) were dissolved.

Layer 3: High-sensitivity red-sensitive emulsion layer containing 1.1 g of a silver iodobromide high-sensitivity red-sensitive emulsion (obtained by red-sensitive of emulsion 1 in Table 2), 1.2 g of gelatin and 0.15 g of TCP in which 0.23 g of the cyan coupler C-18, and 0.020 g of the colored cyan coupler CC-1 were dissolved.

Layer 4: Intermediate layer containing 1.2 g of gelatin and 0.04 g of di-n-butyl phthalate (hereinafter referred to as DBP) in which 0.07 g of 2,5-di-tert-octylhydroquinone (hereinafter referred to as stain preventing agent HQ-1) was dissolved.

Layer 5: Low-sensitivity green-sensitive emulsion layer containing 1.6 g of a silver iodobromide low-sensitivity green-sensitive emulsion (obtained by green-sensitization of emulsion 2 in Table 2), 1.7 g of gelatin and 0.3 g of TCP in which 0.30 g of 1-(2,4,6-trichlorophenyl)-3-[3-(2,4-di-tert-amylphenoxyacetamido]-5-pyrazolone (hereinafter referred to as magenta coupler M-1), 0.20 g of 4,4-methylenebis-[1-(2,4,6-trichlorophenyl)-3-[3-(2,4-di-tert-amylphenoxyacetamido]benzeneamido]-5-pyrazolone (hereinafter referred to as magenta coupler M-19) and 0.066 g of 1-(2,4,6-trichlorophenyl)-4-(1-naphthylazo)-3-(2-chloro-5-octadecenylsuccinimidoanilino)-5-pyrazolone (hereinafter referred to as colored magenta coupler CM-1) were dissolved.

Layer 6: High-sensitivity green-sensitive emulsion layer containing 1.5 g of a silver iodobromide high-sensitivity green-sensitive emulsion (obtained by green-sensitization of emulsion 1 in Table 2), 1.9 g of gelatin and 0.12 g of TCP in which 0.093 g of the magenta coupler M-1, 0.094 g of the magenta coupler M-19, and 0.049 g of the colored magenta coupler CM-1 were dissolved.

Layer 7: Yellow filter layer containing 0.2 g of yellow colloidal silver, 0.11 g of DBP in which 0.2 g of stain preventing agent HQ-1 was dissolved, and 2.1 g of gelatin.

Layer 8: Low-sensitivity blue-sensitive emulsion layer containing 0.95 g of a silver iodobromide low-sensitivity blue-sensitive emulsion (emulsion 2 in Table 2), 1.9 g of gelatin and 0.93 g of DBP in which 1.84 g of α-[4-(1-benzyl-2-phenyl-3,5-dioxo-1,2,4-triazolidinyl)]-α-pivaloyl-2-chloro-5-[γ-(2,4-di-tert-amylphenoxy)butylamido]acetanilide (hereinafter referred to as yellow coupler Y-4) was dissolved.

Layer 9: High-sensitivity blue-sensitive emulsion layer containing 1.2 g of a silver iodobromide high-sensitivity blue-sensitive emulsion (emulsion 1 in Table 2), 2.0 g of gelatin and 0.23 g of DBP in which 0.46 g of the yellow coupler Y-4 was dissolved.

Layer 10: Protective layer containing 2.3 g of gelatin.

Other specimens were prepared in the same way as specimen No. 1, except that emulsions obtained by the color-sensitization of the silver iodobromide emulsions listed in Table 1 were used in respective light-sensitive layers. The physical values of respective silver iodobromide emulsions were as shown in Table 2.

TABLE 1

| | Spcimen No. 1 (Comparative) | Specinen No. 2 (Comparative) | Specimen No. 3 (Comparative) | Specimen No. 4 (Comparative) | Specimen No. 5 (According to the present invention) | Specimen No. 6 (According to the present invention) |
|---|---|---|---|---|---|---|
| Layer 2 | EM - 2 | EM - 4 | EM - 6 | EM - 8 | EM - 6 | EM - 8 |
| Layer 3 | EM - 1 | EM - 3 | EM - 1 | EM - 3 | EM - 5 | EM - 7 |
| Layer 5 | EM - 2 | EM - 4 | EM - 2 | EM - 4 | EM - 6 | EM - 8 |
| Layer 6 | EM - 1 | EM - 3 | EM - 5 | EM - 7 | EM - 5 | EM - 7 |
| Layer 8 | EM - 2 | EM - 4 | EM - 2 | EM - 4 | EM - 6 | EM - 8 |
| Layer 9 | EM - 1 | EM - 3 | EM - 1 | EM - 3 | EM - 5 | EM - 7 |

TABLE 2

| | EM - 1 | EM - 2 | EM - 3 | EM - 4 | EM - 5 | EM - 6 | EM - 7 | EM - 8 |
|---|---|---|---|---|---|---|---|---|
| Mole % of silver iodide | 7% | 7% | 7% | 7% | 2% | 2% | 2% | 2% |
| Average crystal size ($\bar{r}$) | 1.05μ | 0.65μ | 1.04μ | 0.65μ | 1.06μ | 0.66μ | 1.05μ | 0.64μ |
| Standard deviation (S) | 0.25μ | 0.16μ | 0.093μ | 0.05μ | 0.27μ | 0.16μ | 0.084μ | 0.05μ |
| $S/\bar{r}$ | 0.24 | 0.25 | 0.09 | 0.08 | 0.25 | 0.24 | 0.08 | 0.08 |
| Form of grains | Twinned and cubic | Twinned and cubic | Cubic | Cubic | Twinned and cubic | Twinned and cubic | Cubic | Cubic |

The obtained six specimens were respectively subjected to exposure giving the maximum density (exposure giving the maximum density after the exposure to white light through an optical wedge and processing by the processes described below). They were then respectively processed gy the processes described below to yield the specimens having dye images.

| Processing (processing temperature: 38° C.) | Processing time |
|---|---|
| Color development | 3 minutes 15 seconds |
| Bleaching | 6 minutes 30 seconds |
| Washing with water | 3 minutes 15 seconds |
| Fixing | 6 minutes 30 seconds |
| Washing with water | 3 minutes 15 seconds |
| Stabilization | 1 minute 30 seconds |
| Drying | |

The following processing solutions were used in the above-mentioned processing steps:

| | | |
|---|---|---|
| (Color developing solution) | | |
| 4-Amino-3-methyl-N—ethyl-N—(β-hydroxyethyl)-aniline sulfate | 4.75 | g |
| Anhydrous sodium sulfite | 4.25 | g |
| Hydroxylamine half-sulfate | 2.0 | g |
| Anhydrous potassium carbonate | 37.5 | g |
| Sodium bromide | 1.3 | g |
| Trisodium nitrilotriacetate (monohydrate) | 2.5 | g |
| Potassium hydroxide | 1.0 | g |
| Made up to 1 liter with water | | |
| (Bleaching solution) | | |
| Ferric ammonium salt of ethylenediamine-tetraacetic acid | 100.0 | g |
| Diammonium salt of ethylenediamine-tetraacetic acid | 10.0 | g |
| Ammonium bromide | 150.0 | g |
| Glacial acetic acid | 10.0 | ml |
| Made up to 1 liter with water and adjusted to pH 6.0 with aqueous ammonia. | | |
| (Fixing solution) | | |
| Ammonium thiosulfate | 175.0 | g |
| Anhydrous sodium sulfite | 8.6 | g |
| Sodium metasulfite | 2.3 | g |
| Made up to 1 liter with water and adjusted to pH 6.0 with acetic acid. | | |
| (Stabilizing solution) | | |
| Formalin (37% aqueous solution) | 1.5 | ml |
| Konidax (available from Konishiroku Photo Industry Co., Ltd.) | 7.5 | ml |
| Made up to 1 liter with water. | | |

Gelatin of the obtained image was decomposed with pronase for respective layers. Silver iodobromide crystals were separated by centrifuging, and observed by using a scanning type electronic microscope (JSM-T200 available from Nippon Denshi K.K.) to measure the percentage of the undeveloped grans with respect to the total crystals in each layer (dead grain percentage). The results were as shown in Table 3.

TABLE 3

| | Spcimen No. 1 (Comparative) | Specimen No. 2 (Comparative) | Specimen No. 3 (Comparative) | Specimen No. 4 (Comparative) | Specimen No. 5 (According to the present invention) | Specimen No. 6 (According to the present invention) |
|---|---|---|---|---|---|---|
| Layer 2 | 47% | 45% | 45% | 43% | 27% | 20% |
| Layer 3 | 55% | 52% | 46% | 44% | 34% | 27% |
| Layer 5 | 53% | 48% | 44% | 40% | 29% | 23% |
| Layer 6 | 61% | 57% | 59% | 55% | 36% | 30% |
| Layer 8 | 50% | 45% | 48% | 46% | 29% | 22% |
| Layer 9 | 59% | 55% | 57% | 52% | 34% | 28% |

As shown in Table 3, specimen Nos. 5 and 6 in accordance with the present invention exhibited reduced dead grains.

EXAMPLE 2

Specimen No. 1 used in Example 1 was exposed to blue, green and red light through an optical wedge, and developed in the same way as in Example 1. In this way, the minimum exposure log Eo in the exposure to blue, green and red light, which gave the maximum density, was determined. On the other hand, specimen Nos. 1 to 6 used in Example 1 were respectively divided into two sections, and all of these specimens were subjected to the minimum exposure. One section of each specimen was developed in the same way as in Example 1 to obtain a dye image. The other section of each specimen was subjected to the color development conducted in Example 1, a stop processing with a 2% aqueous acetic acid solution, and the fixing and subsequent processes in Example 1 so as to obtain a dye image in which the silver image was not removed. As for the dye image in which the silver image was not removed, the amount of developed silver (Ag) per $m^2$ of the specimen was determined by X-ray fluorimetry. The utilization efficiency of silver for the formation of dye image was determined as the quotient of the image density divided by the amount of developed silver (D/Ag). The results were as shown in Table 4. The amount of developed silver was the value compensated for the colloidal silver amount added during coating.

TABLE 4

| Specimen | | Amount of developed silver ($g/m^2$) | D/Ag |
|---|---|---|---|
| 1 | Exposure to blue light | 0.82 | 0.96 |
| | Exposure to green light | 0.96 | 1.89 |
| | Exposure to red light | 0.50 | 1.56 |
| 2 | Exposure to blue light | 0.90 | 0.98 |
| | Exposure to green light | 1.06 | 1.92 |
| | Exposure to red light | 0.52 | 1.57 |
| 3 | Exposure to blue light | 0.85 | 0.97 |
| | Exposure to green light | 0.99 | 1.90 |
| | Exposure to red light | 0.55 | 1.59 |
| 4 | Exposure to blue light | 0.92 | 0.99 |
| | Exposure to green light | 1.17 | 1.94 |
| | Exposure to red light | 0.57 | 1.60 |
| 5 | Exposure to blue light | 1.24 | 1.08 |
| | Exposure to green light | 1.51 | 2.03 |
| | Exposure to red light | 0.7 | 1.66 |
| 6 | Exposure to blue light | 1.35 | 1.10 |
| | Exposure to green light | 1.65 | 2.16 |
| | Exposure to red light | 0.75 | 1.69 |

As shown in Table 4, specimen Nos. 5 and 6 according to the present invention in which a silver iodobromide emulsion containing a low molar percentage of iodine exhibited lesser dead grains and increased developed silver amount compared with specimen Nos. 1 and 2 in which a silver iodobromide emulsion containing a high molar percentage of silver iodide and specimen No. 3 partially containing a layer of a silver iodobromide emulsion containing a low molar percentage of silver iodide. Further, the specimens in accordance with the present invention exhibited remarkably increased density of dye image obtained from silver iodobromide per unit, and increased utilization efficiency of silver for the formation of dye image.

EXAMPLE 3

Specimen No. 7 was prepared by sequentially applying the layers described below on a transparent support made of an under-coated cellulose triacetate film.

(Specimen No. 7)

Layer 1: Antihalation layer containing 0.4 g of black colloidal silver and 3 g of gelatin.

Layer 2: Low-sensitivity red-sensitive emulsion layer containing 1.5 g of silver iodobromide low-sensitivity red-sensitive emulsion (obtained by red-sensitization of emulsion 9 in Table 6), 1.6 g of gelatin and 0.4 g of TCP in which 0.80 g of the cyan coupler C-18 and 0.018 g of the DIR compound D-100 were dissolved.

Layer 3: High-sensitivity red-sensitive emulsion layer containing 1.1 g of a silver iodobromide high-sensitivity red-sensitive emulsion (obtained by red-sensitization of emulsion 1 in Table 2), 1.2 g of gelatin and 0.15 g of TCP in which 0.23 g of the cyan coupler C-18 and 0.013 g of the DIR compound D-100 were dissolved.

Layer 4: Intermediate layer containing 1.2 g of gelatin and 0.04 g of DBP in which 0.07 g of stain preventing agent HQ-1 was dissolved.

Layer 5: Low-sensitivity green-sensitive emulsion layer containing 1.6 g of a silver iodobromide low-sensitivity green-sensitive emulsion (obtained by green-sensitization of emulsion 9 in Table 6), 1.7 g of gelatin and 0.3 g of TCP in which 0.30 g of magenta coupler M-1, 0.20 g of magenta coupler M-19 and 0.025 g of the DIR compound D-100 were dissolved.

Layer 6: High-sensitivity green-sensitive emulsion layer containing 1.5 g of a silver iodobromide high-sensitivity green-sensitive emulsion (obtained by green-sensitization of emulsion 1 in Table 2), 1.9 g of gelatin and 0.12 g of TCP in which 0.093 g of the magenta coupler M-1, 0.094 g of the magenta coupler M-19 and 0.008 g of the DIR compound D-100 were dissolved.

Layer 7: Yellow filter layer containing 0.2 g of yellow colloidal silver, 0.11 g of DBP in which 0.2 g of stain preventing agent HQ-1 was dissolved, and 2.1 g of gelatin.

Layer 8: Low-sensitivity blue-sensitive emulsion layer containing 0.95 g of a silver iodobromide low-sensitivity blue-sensitive emulsion (emulsion 9 in Table 6), 1.9 g of gelatin and 0.93 g of DBP in which 1.84 g of yellow coupler Y-4 and 0.025 g of the DIR compound D-100 were dissolved.

Layer 9: High-sensitivity blue-sensitive emulsion layer containing 1.2 g of a silver iodobromide high-sensitivity blue-sensitive emulsion (emulsion 1 in Table 2), 2.0 g of gelatin and 0.23 g of DBP in which 0.46 g of the yellow coupler Y-4 and 0.008 g of the DIR compound D-100 were dissolved.

Layer 10: Protective layer containing 2.3 g of gelatin.

Specimen Nos. 8 to 12 were prepared in the same way as specimen No. 7, except that emulsions obtained by the color-sensitization of the silver iodobromide emulsions listed in Table 5 were used in respective light-sensitive layers. The physical values of respective emulsions were as shown in Table 6. The amount of the DIR compound was altered to obtain the equal gamma value. The addition amount for respective specimens were as shown in Table 5.

TABLE 5

| | | Layer 2 | Layer 3 | Layer 5 | Layer 6 | Layer 8 | Layer 9 |
|---|---|---|---|---|---|---|---|
| Specimen No. 7 | Emulsion used | EM-9 | EM-1 | EM-9 | EM-1 | EM-9 | EM-1 |
| (Comparative) | Amount of D-100 used (g) | 0.018 | 0.013 | 0.025 | 0.008 | 0.025 | 0.008 |
| Specimen No. 8 | Emulsion used | EM-10 | EM-3 | EM-10 | EM-3 | EM-10 | EM-3 |
| (Comparative) | Amount of D-100 used (g) | 0.027 | 0.019 | 0.036 | 0.012 | 0.035 | 0.012 |
| Specimen No. 9 | Emulsion used | EM-9 | EM-1 | EM-6 | EM-11 | EM-9 | EM-1 |
| (Comparative) | Amount of D-100 used (g) | 0.018 | 0.013 | 0.032 | 0.010 | 0.025 | 0.008 |
| Specimen No. 10 | Emulsion used | EM-10 | EM-3 | EM-8 | EM-12 | EM-10 | EM-3 |
| (Comparative) | Amount of D-100 used (g) | 0.027 | 0.019 | 0.038 | 0.014 | 0.035 | 0.012 |
| Specimen No. 11 | Emulsion used | EM-6 | EM-11 | EM-6 | EM-11 | EM-6 | EM-11 |
| (According to the present invention) | Amount of D-100 used (g) | 0.026 | 0.018 | 0.032 | 0.010 | 0.031 | 0.011 |
| Specimen No. 12 | Emulsion used | EM-8 | EM-12 | EM-8 | EM-12 | EM-8 | EM-12 |
| (According to the present invention) | Amount of D-100 used (g) | 0.030 | 0.020 | 0.038 | 0.014 | 0.038 | 0.014 |

In Table 5, EM-1, EM-3, EM-6 and EM-8 were the emulsions listed in Table 2 and used in Example 1. EM-9, EM-10, EM-11 and EM-12 were the emulsions listed in Table 6.

TABLE 6

| | EM-9 | EM-10 | EM-11 | EM-12 |
|---|---|---|---|---|
| Mole % of silver iodide | 6% | 6% | 3% | 3% |
| Average crystal size ($\bar{r}$) | 0.64μ | 0.66μ | 1.05μ | 1.04μ |
| Standard deviation (S) | 0.17μ | 0.06μ | 0.27μ | 0.09μ |
| S/$\bar{r}$ | 0.27 | 0.09 | 0.26 | 0.09 |
| Form of grains | Twinned and cubic | Cubic | Twinned and cubic | Cubic |

The obtained specimens were individually brought into close contact with a transparent square wave chart or wedge, and exposed to blue, green and red monochromatic light, followed by the color development according to the procedure described in Example 1. The results of the photographic characteristics, sharpness and graininess were as shown in Table 7.

The effect of improvement in the image sharpness was evaluated by determining the modulation transfer function (MTF) and comparing the MTF values at spatial frequencies of 10 lines/mm and 30 lines/mm.

The graininess (RMS) was evaluated by obtaining the standard deviation of the fluctuation in the density values occurring when a color image having a color image density of 1.0 is scanned with a microdensitometer having a circular scanning aperture of diameter of 25μ, and comparing the value obtained by magnifying the standard deviation by a factor of 1000.

The gamma value is expressed by tan α in which α designates the angle between the extension of the straight section of the photographic characteristic curve and the horizontal axis. The sensitivity is expressed by the relative value of the logarithm of the reciprocal of the exposure that is able to give the density of fog density plus 0.1. The blue, green and red sensitivities of each specimen were expressed by the relative values, with those of specimen No. 7 taken as 100.

TABLE 7

| Specimen No. | | Relative sensitivity | γ (gamma) | MTF value (%) 10 lines/mm | 30 lines/mm | RMS |
|---|---|---|---|---|---|---|
| 7 | Exposure to blue light | 100 | 0.87 | 89 | 57 | 55 |
| (Comparative) | Exposure to green light | 100 | 0.85 | 86 | 49 | 34 |
| | Exposure to red light | 100 | 0.88 | 78 | 33 | 39 |
| 8 | Exposure to blue light | 105 | 0.86 | 111 | 82 | 47 |
| (Comparative) | Exposure to green light | 106 | 0.86 | 112 | 75 | 27 |
| | Exposure to red light | 104 | 0.88 | 98 | 53 | 32 |
| 9 | Exposure to blue light | 99 | 0.87 | 90 | 56 | 54 |
| (Comparative) | Exposure to green light | 100 | 0.85 | 90 | 52 | 35 |
| | Exposure to red light | 98 | 0.88 | 77 | 35 | 40 |
| 10 | Exposure to blue light | 107 | 0.87 | 110 | 79 | 46 |
| (Comparative) | Exposure to green light | 105 | 0.85 | 118 | 78 | 28 |
| | Exposure to red light | 105 | 0.85 | 103 | 59 | 31 |
| 11 | Exposure to blue light | 103 | 0.86 | 128 | 85 | 53 |
| (According to | Exposure to green light | 102 | 0.88 | 127 | 80 | 36 |
| the present | Exposure to red light | 103 | 0.85 | 109 | 65 | 39 |
| invention) | | | | | | |
| 12 | Exposure to blue light | 106 | 0.88 | 132 | 101 | 45 |
| (According to | Exposure to green light | 107 | 0.85 | 130 | 97 | 27 |
| the present | Exposure to red light | 105 | 0.86 | 119 | 78 | 30 |
| invention) | | | | | | |

The above six specimens were respectively subjected to exposure giving the maximum density. They were then developed and subjected to the separation processing for respective layers in the same way as in Example 1. The dead grain percentage was measured to obtain the results shown in Table 8.

TABLE 8

| | Specimen No. 7 (Comparative) | Specimen No. 8 (Comparative) | Specimen No. 9 (Comparative) | Specimen No. 10 (Comparative) | Specimen No. 11 (According to the present invention) | Specimen No. 12 (According to the present invention) |
|---|---|---|---|---|---|---|
| Layer 2 | 45% | 44% | 45% | 43% | 27% | 21% |
| Layer 3 | 54% | 52% | 52% | 50% | 36% | 29% |
| Layer 5 | 52% | 46% | 42% | 39% | 30% | 23% |
| Layer 6 | 61% | 59% | 49% | 47% | 37% | 31% |
| Layer 8 | 48% | 43% | 47% | 43% | 29% | 24% |
| Layer 9 | 57% | 53% | 57% | 52% | 35% | 29% |

As shown in Table 8, the present invention can reduce dead grains even when the gamma characteristics are controlled with the DIR compound. Table 8 also shows that the sharpness is greatly improved if the light-sensitive material in accordance with the present invention is combined with the DIR compound. Thus, the present invention is advantageous also for improving the image quality.

EXAMPLE 4

Specimen No. 13 was prepared by sequentially applying the layers described below on a transparent support made of an under-coated cellulose triacetate film.

(Spcimen No. 13)

Layer 1: Antihalation layer containing 0.4 g of black colloidal silver and 3 g of gelatin.

Layer 2: Low-sensitivity red-sensitive emulsion layer containing 1.5 g of silver iodobromide low-sensitivity red-sensitive emulsion (obtained by red-sensitization of EM-8 used in Example 1), 1.6 g of gelatin and 0.80 g of the cyan coupler C-18.

Layer 3: High-sensitivity red-sensitive emulsion layer containing 1.1 g of a silver iodobromide high-sensitivity red-sensitive emulsion (emulsion obtained by red-sensitization of EM-7 used in Example 1), 1.2 g of gelatin and 0.15 g of TCP in which 0.23 g of the cyan coupler C-18 was dissolved.

Layer 4: Intermediate layer containing 1.2 g of gelatin and 0.04 g of DBP in which 0.07 g of the stain preventing agent HQ-1 was dissolved.

Layer 5: Low-sensitivity green-sensitive emulsion layer containing 1.6 g of a silver iodobromide low-sensitivity green-sensitive emulsion (emulsion obtained by green-sensitization of EM-8 used in Example 1), 1.7 g of gelatin and 0.3 g of TCP in which 0.40 g of 1-(2,4,6-trichlorophenyl)-3-[3-(octadecenylsuccinimide)-2-chloro]anilino-5-pyrazolone (magenta coupler M-6) was dissolved.

Layer 6: High-sensitivity green-sensitive emulsion layer containing 1.5 g of a silver iodobromide high-sensitivity green-sensitive emulsion (obtained by green-sensitization of EM-7 used in Example 1), 1.9 g of gelatin and 0.12 g of TCP in which 0.14 g of the magenta coupler M-6 was dissolved.

Layer 7: Yellow filter layer containing 0.2 g of yellow colloidal silver, 0.11 g of DBP in which 0.2 g of stain preventing agent HQ-1 was dissolved, and 2.1 g of gelatin.

Layer 8: Low-sensitivity blue-sensitive emulsion layer containing 0.95 g of a silver iodobromide low-sensitivity blue-sensitive emulsion (EM-8 used in Example 1), 1.9 g of gelatin and 0.93 g of DBP in which 1.84 g of α-[4-(1-benzyl-2-phenyl-3,5-dioxo-1,2,4-triazolidin-4-yl)]-α-pivaloyl-2-chloro-5-[γ-(2,4-di-tert-amylphenoxyl)butaneamido]acetanilide (yellow coupler Y-5) was dissolved.

Layer 9: High-sensitivity blue-sensitive emulsion layer containing 1.2 g of a silver iodobromide high-sensitivity blue-sensitive emulsion (EM-7 in Example 1), 2.0 g of gelatin and 0.23 g of DBP in which 0.46 g of the yellow coupler Y-5 was dissolved.

Layer 10: Protective layer containing 2.3 g of gelatin.

Specimen No. 14 was prepared in the same way as specimen No. 13 except that 1-hydroxy-2-[δ-(2,4-di-tert-amylphenoxybutyl]naphthoamide (cyan coupler C-1) was used instead of C-18, the magenta coupler M-1 was used instead of M-6, and α-(1-benzyl-2,4-dioxo-imidazolidin-3-yl)-α-pivaloyl-2-chloro-5-[γ-(2,4-di-tert-amylphenoxy)butaneamido]acetanilide (yellow coupler Y-2) was used instead of the yellow coupler Y-4.

The obtained two specimens were respectively subjected to exposure giving the maximum density. They were then developed and subjected to the separation processing for respective layers in the same way as in Example 1. The dead grain percentage was measured to obtain the results shown in Table 9.

TABLE 9

| | Specimen No. 13 | Specimen No. 14 |
|---|---|---|
| Layer 2 | 20% | 26% |
| Layer 3 | 28% | 35% |
| Layer 5 | 19% | 27% |
| Layer 6 | 27% | 34% |
| Layer 8 | 17% | 25% |
| Layer 9 | 23% | 31% |

The couplers used in respective specimens and the specific rates with respect to M-1 were as shown in Table 10.

TABLE 10

| | Specimen No. 13 | | Specimen No. 14 | |
|---|---|---|---|---|
| | Coupler | Specific rate | Coupler | Specific rate |
| Layer 2, 3 | C - 18 | 1.22 | C - 1 | 0.98 |
| Layer 5, 6 | M - 6 | 1.28 | M - 1 | 1.00 |
| Layer 8, 9 | Y - 5 | 1.39 | Y - 2 | 0.70 |

Both specimen Nos. 13 and 14 fall within the scope of the present invention. Table 10 shows that dead grains reduce to a larger degree when a coupler exhibiting a specific rate larger than that of M-1 is used.

EXAMPLE 5

Specimen Nos. 15 to 17 were prepared by sequentially applying the layers described below on a transparent support made of an under-coated cellulose triacetate film.

Layer 1: Antihalation layer containing 0.4 g of black colloidal silver and 3 g of gelatin.

Layer 2: Low-sensitivity red-sensitive emulsion layer containing 1.5 g of silver iodobromide low-sensitivity red-sensitive emulsion (obtained by red-sensitization of an emulsion in Table 11), 1.6 g of gelatin and 0.4 g of TCP in which 0.80 g of the cyan coupler C-18 was dissolved.

Layer 3: High-sensitivity red-sensitive emulsion layer containing 1.1 g of a silver iodobromide high-sensitivity red-sensitive emulsion (obtained by red-sensitization of an emulsion in Table 11), 1.2 g of gelatin and 0.15 g of TCP in which 0.23 g of the cyan coupler C-18 was dissolved.

Layer 4: Intermediate layer containing 1.2 g of gelatin and 0.04 g of DBP in which 0.07 g of the stain preventing agent HQ-1 was dissolved.

Layer 5: Low-sensitivity green-sensitive emulsion layer containing 1.6 g of a silver iodobromide low-sensitivity green-sensitive emulsion (obtained by green-sensitization of an emulsion in Table 11), 1.7 g of gelatin and 0.3 g of TCP in which 0.40 g of the magenta coupler M-1 was dissolved.

Layer 6: High-sensitivity green-sensitive emulsion layer containing 1.5 g of a silver iodobromide high-sensitivity green-sensitive emulsion (obtained by green-sensitization of an emulsion in Table 11), 1.9 g of gelatin and 0.12 g of TCP in which 0.14 g of the magenta coupler M-1 was dissolved.

Layer 7: Yellow filter layer containing 0.2 g of yellow colloidal silver, 0.11 g of DBP in which 0.2 g of stain preventing agent HQ-1 was dissolved, and 2.1 g of gelatin.

Layer 8: Low-sensitivity blue-sensitive emulsion layer containing 0.95 g of a silver iodobromide low-sensitivity blue-sensitive emulsion (an emulsion in Table 11), 1.9 g of gelatin and 0.93 g of DBP in which 1.84 g of the yellow coupler Y-1 was dissolved.

Layer 9: High-sensitivity blue-sensitive emulsion layer containing 1.2 g of a silver iodobromide high-sensitivity blue-sensitive emulsion (an emulsion Table 11), 2.0 g of gelatin and 0.23 g of DBP in which 0.46 g of the yellow coupler Y-1 was dissolved.

Layer 10: Protective layer containing 2.3 g of gelatin.

TABLE 11

| | Specimen No. 15 | Specimen No. 16 | Specimen No. 17 |
|---|---|---|---|
| Layer 2 | EM - 8 | EM - 13 | EM - 15 |
| Layer 3 | EM - 7 | EM - 14 | EM - 16 |
| Layer 5 | EM - 8 | EM - 13 | EM - 15 |
| Layer 6 | EM - 7 | EM - 14 | EM - 16 |
| Layer 8 | EM - 8 | EM - 13 | EM - 15 |
| Layer 9 | EM - 7 | EM - 14 | EM - 16 |

EM-7, EM-8: Emulsions listed in Table 2 and used in Example 1.

TABLE 12

| | EM-13 | EM-14 | EM-15 | EM-16 |
|---|---|---|---|---|
| Mole % of silver iodide | 2% | 2% | 2% | 2% |
| Average crystal size ($\bar{r}$) | 0.64μ | 1.03μ | 0.63μ | 1.05μ |
| Standard deviation (S) | 0.05μ | 0.10μ | 0.06μ | 0.09μ |
| $S/\bar{r}$ | 0.08 | 0.10 | 0.10 | 0.9 |
| Form of grains | octa-hedral | Octa-hedral | Tetra-deca-hedral | Tetra-deca-hedral |

The obtained three specimens were respectively subjected to exposure giving the maximum density. They were then developed and subjected to the separation processing for respective layers in the same way as in Example 1. The dead grain percentage was measured to obtain the results shown in Table 13.

TABLE 13

| | Specimen No. 15 | Specimen No. 16 | Specimen No. 17 |
|---|---|---|---|
| Layer 2 | 20% | 17% | 18% |
| Layer 3 | 28% | 24% | 24% |
| Layer 5 | 23% | 19% | 19% |
| Layer 6 | 31% | 28% | 27% |
| Layer 8 | 23% | 17% | 18% |
| Layer 9 | 28% | 23% | 24% |

Specimen Nos. 15, 16 and 17 fall within the scope of the present invention. As shown in Table 11, the effect of the present invention is larger when octahedral or tetradecahedral silver iodobromide crystals are used than when cubic crystals are used.

EXAMPLE 6

The light-sensitive photographic materials in accordance with the present invention, which were used in Example 3 (specimen Nos. 7, 8, 11 and 12) were separation-exposed to blue, green and red light through a wedge, and processed by the processes described below to yield the specimens having the dye images.

| Processes (processing temperature: 25° C.) | Processing time |
|---|---|
| Color development | 3 minutes 30 seconds |
| Bleaching | 6 minutes 30 seconds |
| Washing with water | 3 minutes 15 seconds |
| Fixing | 6 minutes 30 seconds |
| Washing with water | 3 minutes 15 seconds |
| Stabilization | 1 minute 30 seconds |
| Drying | |

The compositions of the processing solutions used in the above-mentioned processes were the same as those in Example 1.

The photographic characteristics of the obtained color images were compared with those obtained by processing the specimen Nos. 7, 8, 11 and 12 in Example 3 at a processing temperature of 38° C. The results were as shown in Table 14.

TABLE 14

| Specimen No. | | Processing at 38° C. Relative sensitivity | Processing at 38° C. Gamma | Processing at 25° C. Relative sensitivity | Processing at 25° C. Gamma |
|---|---|---|---|---|---|
| 7 | Exposure to blue light | 100 | 0.87 | 65 | 0.57 |
| | Exposure to green light | 100 | 0.85 | 57 | 0.48 |
| | Exposure to red light | 100 | 0.88 | 51 | 0.45 |
| 8 | Exposure to blue light | 105 | 0.86 | 70 | 0.60 |
| | Exposure to green light | 106 | 0.86 | 63 | 0.50 |
| | Exposure to red light | 104 | 0.88 | 57 | 0.50 |
| 11 | Exposure to blue light | 103 | 0.86 | 98 | 0.84 |
| | Exposure to green light | 102 | 0.88 | 97 | 0.85 |
| | Exposure to red light | 103 | 0.85 | 96 | 0.81 |
| 12 | Exposure to blue light | 106 | 0.88 | 101 | 0.88 |
| | Exposure to green light | 107 | 0.85 | 99 | 0.84 |
| | Exposure to red light | 105 | 0.86 | 98 | 0.84 |

As shown in Table 14, even when the specimens in accordance with the present invention are processed at a low temperature, they exhibit characteristics equivalent to those obtained with a high-temperature development conducted for the same development time. This indicates that the light-sensitive material in accordance with the present invention allows quick processing even at low temperatures.

We claim:

1. A light-sensitive color photographic material having a support and, coated thereon, at least two light-sensitive silver halide emulsion layers respectively sensitive to light of a different spectral region, each of said emulsion layers comprising at least two light-sensitive emulsion sublayers having different sensitivity to light and containing negative type light-sensitive silver halide crystals consisting essentially of silver iodobromide containing silver iodide in an amount of from 1 to 3 mole %.

2. The light-sensitive color photographic material according to claim 1 wherein the negative type silver halide crystals contained in at least one of said at least two light-sensitive emulsion sublayers have a monodispersed size distribution satisfying the following relationship:

$$S/\bar{r} \leqq 0.15$$

wherein $$S = \sqrt{\Sigma(\bar{r} - r_i)^2 n_i^2 / \Sigma n_i}$$

$$\bar{r} = \Sigma n_i r_i / \Sigma n_i$$

in which S designates the standard deviation, r designates the average crystal size, $r_i$ designates the crystal sizes of the individual crystals, and $n_i$ designates the number of crystals.

3. The light-sensitive color photographic material according to claim 2 wherein the negative type silver halide crystals contained in all of said light-sensitive emulsion sublayers have a monodispersed size distribution satisfying the following relationship:

$$S/\bar{r} \leqq 0.15$$

wherein $$S = \sqrt{\Sigma(\bar{r} - r_i)^2 n_i^2 / \Sigma n_i}$$

$$\bar{r} = n_i r_i / n_i$$

in which S designates the standard deviation, r designates the average crystal size, $r_i$ designates the crystal sizes of the individual crystals, and $n_i$ designates the number of crystals.

4. The light-sensitive color photographic material according to claim 2 wherein the negative type silver halide crystals contained in at least one of said at least two light-sensitive emulsion sublayers consists essentially of octahedrons, tetradecahedrons, or a combination of octahedrons and tetradecahedrons.

5. The light-sensitive color photographic material according to claim 4 wherein the negative type silver halide crystals contained in all of said light-sensitive emulsion sublayers consist essentially of octahedrons, tetradecahedrons or a combination of octahedrons and tetradecahedrons.

6. The light-sensitive color photographic material according to claim 1 wherein at least one of said emulsion layers comprises at least two light-sensitive emulsion sublayers containing silver halide crystals having different average crystal sizes.

7. The light-sensitive color photographic material according to claim 2 wherein at least one of said emulsion layers comprises at least two light-sensitive emulsion sublayers containing silver halide crystals having different average crystal sizes.

8. The light-sensitive color photographic material according to claim 3 wherein at least one of said emulsion layers comprises at least two light-sensitive emulsion sublayers containing silver halide crystals having different average crystal sizes.

9. The light-sensitive color photographic material according to claim 5 wherein at least one of said emulsion layers comprises at least two light-sensitive emulsion sublayers containing silver halide crystals having different average crystal sizes.

* * * * *